US012084253B2

(12) United States Patent
Fu et al.

(10) Patent No.: US 12,084,253 B2
(45) Date of Patent: Sep. 10, 2024

(54) APPARATUSES AND METHODS FOR PACKAGING

(71) Applicant: ZHEJIANG DAHUA TECHNOLOGY CO., LTD., Zhejiang (CN)

(72) Inventors: Qiujia Fu, Hangzhou (CN); Yikun Liang, Hangzhou (CN); Qianli Zhang, Hangzhou (CN)

(73) Assignee: ZHEJIANG DAHUA TECHNOLOGY CO., LTD., Hangzhou (CN)

( * ) Notice: Subject to any disclaimer, the term of this patent is extended or adjusted under 35 U.S.C. 154(b) by 15 days.

(21) Appl. No.: 17/654,813

(22) Filed: Mar. 14, 2022

(65) Prior Publication Data

US 2022/0204240 A1 Jun. 30, 2022

Related U.S. Application Data

(63) Continuation of application No. PCT/CN2020/118825, filed on Sep. 29, 2020.

(30) Foreign Application Priority Data

| | | |
|---|---|---|
| Sep. 30, 2019 | (CN) | 201921652674.4 |
| Sep. 30, 2019 | (CN) | 201921662639.0 |
| Apr. 14, 2020 | (CN) | 202020548982.9 |

(51) Int. Cl.

| | |
|---|---|
| ***B65D 81/02*** | (2006.01) |
| ***B65D 5/50*** | (2006.01) |
| ***B65D 81/05*** | (2006.01) |

(52) U.S. Cl.

CPC ..... *B65D 81/05* (2013.01); *B65D 5/5028* (2013.01)

(58) Field of Classification Search

CPC .... B65D 5/5028; B65D 25/102; B65D 81/05; B65D 81/07; B65D 2581/051

(Continued)

(56) References Cited

U.S. PATENT DOCUMENTS 5,678,695 A * 10/1997 Ridgeway ..... B65D 5/5028 206/583
6,073,761 A * 6/2000 Jones ..... B65D 5/5028 206/583

(Continued)

FOREIGN PATENT DOCUMENTS

CN 102700836 A 10/2012
CN 207482389 U 6/2018

(Continued)

OTHER PUBLICATIONS

The Extended European Search Report in European Application No. 20871951.8 mailed on Sep. 22, 2022, 6 pages.

(Continued)

*Primary Examiner* — Luan K Bui
(74) *Attorney, Agent, or Firm* — METIS IP LLC

(57) ABSTRACT

The present disclosure provides a packaging apparatus. The packaging apparatus may include a main body. The main body may include a base plate, a first side plate, and a second side plate. The first side plate and the second side plate may be distributed around the base plate. The packaging apparatus may include an elastic sheet disposed above the base plate. The elastic sheet may include a first fixing part and a second fixing part. The first fixing part and the second fixing part may be connected with the first side plate and the second side plate, respectively. A space may be configured between the base plate and the elastic sheet. When the packaging apparatus is used to package a subject, the first (Continued)

side plate and the second side plate may be folded away from a side of the base plate where the subject is located.

16 Claims, 34 Drawing Sheets

(58) Field of Classification Search
USPC ..... 206/583, 591, 594
See application file for complete search history.

(56) References Cited

U.S. PATENT DOCUMENTS

| | | | | |
|---|---|---|---|---|
| 6,148,590 | A * | 11/2000 | Ridgeway | B65D 81/075 206/583 |
| 6,158,589 | A * | 12/2000 | Smith | B65D 5/5028 206/466 |
| 6,311,843 | B1 * | 11/2001 | Smith | B65D 5/5028 206/466 |
| 7,918,339 | B2 * | 4/2011 | Kashiwabara | B65D 5/5028 206/583 |
| 2006/0213803 | A1 * | 9/2006 | Saitou | B65D 81/05 206/583 |
| 2011/0240515 | A1 * | 10/2011 | Ridgeway | B65D 5/5028 53/472 |
| 2013/0233752 | A1 * | 9/2013 | Hammerschmidt | B65D 5/5028 53/467 |
| 2014/0183097 | A1 * | 7/2014 | LeRoy | B65D 81/05 206/583 |
| 2014/0246352 | A1 * | 9/2014 | Roberts | B65D 81/075 206/583 |

FOREIGN PATENT DOCUMENTS

| | | | |
|---|---|---|---|
| CN | 208307444 | U | 1/2019 |
| CN | 109955550 | A | 7/2019 |
| CN | 210417320 | U | 4/2020 |
| CN | 210455545 | U | 5/2020 |
| CN | 210618774 | U | 5/2020 |
| CN | 211167784 | U | 8/2020 |
| JP | 2001130640 | A | 5/2001 |
| JP | 2015078008 | A | 4/2015 |
| JP | 2016064860 | A | 4/2016 |

OTHER PUBLICATIONS

International Search Report in PCT/CN2020/118825 mailed on Dec. 30, 2020, 5 pages.
Written Opinion in PCT/CN2020/118825 mailed on Dec. 30, 2020, 7 pages.

* cited by examiner

1200

APPARATUSES AND METHODS FOR PACKAGING

CROSS-REFERENCE TO RELATED APPLICATIONS

This application is a continuation of International Application No. PCT/CN2020/118825, filed on 29 Sep. 2020, which claims priority to Chinese Patent Application No. 201921662639.0 filed on Sep. 30, 2019, Chinese Patent Application No. 201921652674.4 filed on Sep. 30, 2019, and Chinese Patent Application No. 202020548982.9 filed on Apr. 14, 2020, the contents of each of which are incorporated herein by reference in their entirety

TECHNICAL FIELD

The present disclosure relates to packaging field, in particular, to a packaging apparatus.

BACKGROUND

A package structure including an elastic film and a paper card is widely used for product package. Specifically, using the package structure, a product may be placed on the paper card, the elastic film may cover the product and connected with the paper card. The product is packaged by pressing the product on the paper card based on the elasticity of the elastic film.

For a product with a relatively high buffer requirement, such a fragile product, a precise instrument, etc., the product may be damaged when the product is impacted during transportation or testing of the product, which may affect the performance of the product. Therefore, it is desirable to provide a packaging apparatus with improved protection and cushion performance for the product, thereby improving the safety of the product.

SUMMARY

According to an aspect of the present disclosure, a packaging apparatus is provided. The packaging apparatus may include a main body and an elastic sheet. The main body may include a base plate, a first side plate, and a second side plate. The first side plate and the second side plate may be distributed around the base plate. The elastic sheet may be disposed above the base plate. The elastic sheet may include a first fixing part and a second fixing part. The first fixing part and the second fixing part may be connected with the first side plate and the second side plate, respectively. A space may be configured between the base plate and the elastic sheet. When the packaging apparatus is used to package a subject, the first side plate and the second side plate may be folded away from a side of the base plate where the subject is located.

In some embodiments, the elastic sheet may be configured to position the subject on the base plate when the elastic sheet is stretched along the folding of the first side plate and the second side plate.

In some embodiments, the main body may include at least one folding plate disposed between the base plate and at least one of the first side plate or the second side plate. Each of the at least one folding plate may be folded in half between the base plate and one of the first side plate and the second side plate when the first side plate and the second side plate are folded.

In some embodiments, a first folding line may be disposed between each of the at least one folding plate and the base plate. A second folding line may be disposed between each of the at least one folding plate and one of the first side plate and the second side plate. One or more cutting lines may be disposed between each of the at least one folding plate and the base plate or each of the at least one folding plate and one of the first side plate and the second side plate. Each of the one or more cutting lines may be connected with the first folding line and the second folding line.

In some embodiments, a third folding line may be disposed between the first folding line and the second folding line. Each of the at least one folding plate may be divided into a first folding portion and a second folding portion along the third folding line. The first folding portion and the second folding portion may be folded in half along the third folding line between the base plate and the one of the first side plate and the second side plate when the first side plate and the second side plate are folded.

In some embodiments, a fourth folding line may be disposed between the base plate and one of the first side plate and the second side plate corresponding to each of the at least one folding plate. The third folding line may be collinear with the fourth folding line.

In some embodiments, a shape of one of the at least one folding plate may include a triangle, a quadrilateral, or a hexagon.

In some embodiments, the at least one folding plate disposed between the first side plate and the base plate and the at least one folding plate disposed between the second side plate and the base plate may be distributed symmetrically.

In some embodiments, a third folding line may be disposed between the base plate, one of the at least one side plate, and the folding plate. A cutting line may be disposed between the folding plate, one of the at least one side plate, and the base plate. Two ends of the cutting line may be connected with two ends of the third folding line, respectively.

In some embodiments, the main body may further include a third side plate and a fourth side plate distributed around the base plate. When the packaging apparatus is used to package the subject, the third side plate and the fourth side plate may be folded toward the side of the base plate where the subject is located.

In some embodiments, the base plate may include a first side edge corresponding to the first side plate, a second side edge corresponding to the second side plate, a third side edge corresponding to the third side plate, and a fourth side edge corresponding to the fourth side plate. The main body may include a protruding member protruded along at least one of the first side edge or the second side edge of the base plate when the first side plate, the second side plate, the third side plate, and the fourth side plate are folded. The protruding member may be configured to prevent a contact between the at least one of the first side edge or the second side edge of the base plate and a packaging carton when the packaging apparatus is located in the packaging carton.

In some embodiments, the protruding member may include at least one of a first protruding plate or a second protruding plate. The first protruding plate may be disposed along the first side edge or the second side edge, and the second protruding plate may be an extension portion of the third side plate or the fourth side plate.

In some embodiments, a shape of the first protruding plate or the second protruding plate may include a quadrangle or a triangle.

In some embodiments, the at least one of the first side plate or the second side plate corresponding to the first protruding plate may include a notch configured to accommodate the first protruding plate, and an edge of the notch may conform an edge of the first protruding plate.

In some embodiments, the main body may further include a supporting member, and the supporting member may include a first supporting plate and a second supporting plate. The first supporting plate may be disposed beside the third side plate. The second supporting plate may be disposed beside the fourth side plate. A protection space may be formed between the first supporting plate and the second supporting plate after the first supporting plate and the second supporting plate are folded toward an inner side of the third side plate and the fourth side plate, respectively.

In some embodiments, the first supporting plate may include a first top plate and a first foldback plate, and the second supporting plate may include a second top plate and a second foldback plate. The first top plate may be disposed beside the third side plate. The first foldback plate may be disposed beside the first top plate away from the third side plate. The second top plate may be disposed beside the fourth side plate. The second foldback plate may be disposed beside the second top plate away from the fourth side plate.

In some embodiments, the main body may further include a protection member which is disposed within the protection space.

In some embodiments, the protection member may include a first connection plate and a second connection plate. The first connection plate may be disposed beside a side of the first foldback plate away from the first top plate, and the second connection plate may be disposed beside a side of the second foldback plate away from the second top plate. The first connection plate and the second connection plate may be physically connected after the first supporting plate and the second supporting plate are folded.

In some embodiments, the first connection plate may include a connection ear plate, and the second connection plate may include a connection slot that is configured to be engaged with the connection ear plate to connect the first supporting plate and the second supporting plate.

In some embodiments, the protection member may include a first protection ear plate, a second protection ear plate, a third protection ear plate, and a fourth protection ear plate. The first protection ear plate and the second protection ear plate may be disposed beside two sides of the first foldback plate, respectively. The third protection ear plate and the fourth protection ear plate may be disposed beside two sides of the second foldback plate, respectively. At least two of the first protection ear plate, the second protection ear plate, the third protection ear plate, and the fourth protection ear plate may be physically connected after the first supporting plate and the second supporting plate are folded.

In some embodiments, the protection member may include a first cross plate and a second cross plate. The first cross plate may be cross connected with the second cross plate after the first supporting plate and the second supporting plate are folded.

In some embodiments, the first cross plate may include a first clamping part, and the second cross plate may include a second clamping part. The first clamping part may be engaged with the second clamping part to connect the first cross plate with the second cross plate crosswise.

Additional features will be set forth in part in the description which follows, and in part will become apparent to those skilled in the art upon examination of the following and the accompanying drawings or may be learned by production or operation of the examples. The features of the present disclosure may be realized and attained by practice or use of various aspects of the methodologies, instrumentalities, and combinations set forth in the detailed examples discussed below.

BRIEF DESCRIPTION OF THE DRAWINGS

The present disclosure is further described in terms of exemplary embodiments. These exemplary embodiments are described in detail with reference to the drawings. The drawings are not scaled. These embodiments are non-limiting exemplary embodiments, in which like reference numerals represent similar structures throughout the several views of the drawings, and wherein.

DETAILED DESCRIPTION

Figure 1:
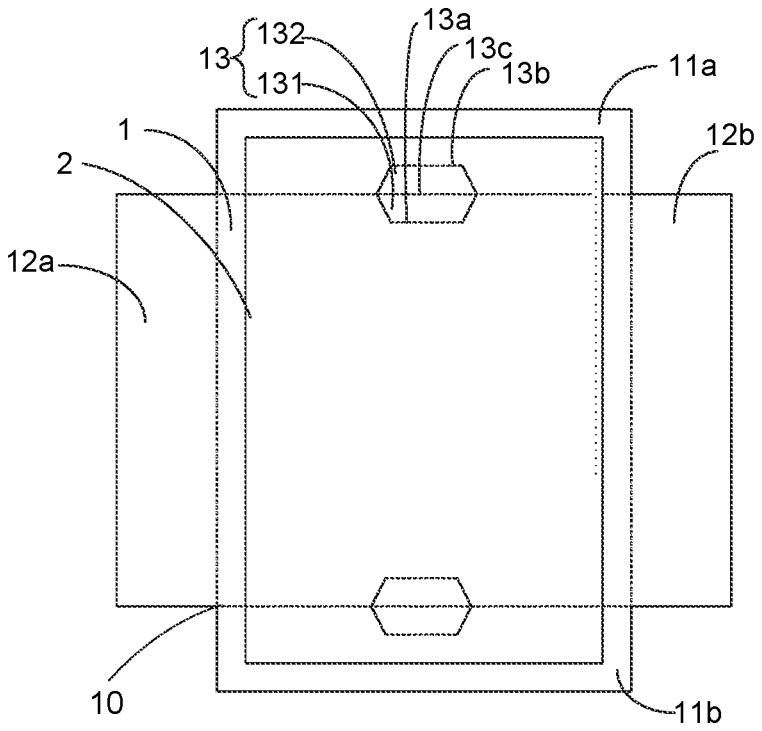
FIG. 1 is a schematic diagram illustrating a packaging apparatus according to some embodiments of the present disclosure.

The following description is presented to enable any person skilled in the art to make and use the present disclosure and is provided in the context of a particular application and its requirements. Various modifications to the disclosed embodiments will be readily apparent to those skilled in the art, and the general principles defined herein may be applied to other embodiments and applications without departing from the spirit and scope of the present disclosure. Thus, the present disclosure is not limited to the embodiments shown but is to be accorded the widest scope consistent with the claims.

The terminology used herein is for the purpose of describing particular example embodiments only and is not intended to be limiting. As used herein, the singular forms "a," "an," and "the" may be intended to include the plural forms as well, unless the context clearly indicates otherwise. It will be further understood that the terms "comprise," "comprises," and/or "comprising," "include," "includes," and/or "including" when used in this disclosure, specify the presence of stated features, integers, steps, operations, elements, and/or components, but do not preclude the presence or addition of one or more other features, integers, steps, operations, elements, components, and/or groups thereof.

It will be understood that, although the terms "first," "second," "third," etc., may be used herein to describe various elements, these elements should not be limited by these terms. These terms are only used to distinguish one element from another. For example, a first element could be termed a second element, and, similarly, a second element could be termed a first element, without departing from the scope of example embodiments of the present invention. Unless the context clearly indicates otherwise, the terms "front", "rear", "lower", and/or "upper" are only for illustration purposes, and are not limited to a location or a spatial orientation.

In some embodiments, the numbers expressing quantities, properties, and so forth, used to describe and claim certain embodiments of the application are to be understood as being modified in some instances by the term "about," "approximate," or "substantially." For example, "about," "approximate" or "substantially" may indicate ±20% variation of the value it describes, unless otherwise stated. Accordingly, in some embodiments, the numerical parameters set forth in the written description and attached claims are approximations that may vary depending upon the desired properties sought to be obtained by a particular embodiment. In some embodiments, the numerical parameters should be construed in light of the number of reported significant digits and by applying ordinary rounding techniques. Notwithstanding that the numerical ranges and parameters setting forth the broad scope of some embodiments of the application are approximations, the numerical values set forth in the specific examples are reported as precisely as practicable.

An aspect of the present disclosure discloses a packaging apparatus. The packaging apparatus may include a main body and an elastic sheet. The main body may include a base plate, a first side plate, and a second side plate. The first side plate and the second side plate may be distributed around the base plate. In some embodiments, the first side plate and the second side plate may be disposed beside two opposite side edges of the base plate. As used herein, the two opposite side edges of the base plate refer to two edges of the base plate that are not intersected. For example, the two opposite side edges of the base plate may be substantially parallel with each other.

The elastic sheet may be disposed above the base plate. The elastic sheet may include a first fixing part and a second fixing part. The first fixing part and the second fixing part may be connected with the first side plate and the second side plate, respectively. When the packaging apparatus is used to package a subject, a subject may be placed between the base plate and the elastic sheet. The first side plate and the second side plate may be folded toward the back side of the base plate that is opposite to the front side of the base plate where the subject is located. The elastic sheet may be stretched along the folding of the first side plate and the second side plate. The elastic sheet may be configured to fasten the subject (e.g., a product) when being stretched. As used herein, the front side of the base plate refers to a surface of the base plate where the elastic sheet or the subject is located. Correspondingly, a surface relative to the front side is defined as the back side of the base plate.

In some embodiments, the first fixing part and the second fixing part of the elastic sheet may be physically connected with the first side plate and the second side plate, respectively. The elastic sheet may be configured to fasten the subject (e.g., a product) when being stretched by folding the first side plate and the second side plate towards the back side of the base plate.

In some embodiments, when the first side plate and the second side plate of the main body are folded toward the back side of the base plate and fitted to the base plate, the base plate and the first side plate and the second side plate may protect the product. For a product with a relatively high cushion requirement (e.g., a fragile product), the product may be damaged when an impact occurs instantly during transportation or testing of the product, and the package structure may not perform a cushion function needed by the product, which may affect the safety of the product. Therefore, it is necessary to improve the cushioning performance of the package apparatus.

On this basis, some embodiments of the present disclosure provide a packaging apparatus. A packaging apparatus may be designed so that when the packaging apparatus is folded, at least one layer of cardboard may be disposed between the base plate and side plates to protect the product, thereby improving the cushioning performance of the packaging apparatus, enhancing the protection performance of the package structure for the product, and not increasing the cost.

FIG. 1 is a schematic diagram illustrating an exemplary packaging apparatus according to some embodiments of the present disclosure. As shown in FIG. 1, the packaging apparatus may include a main body 10 and an elastic sheet 2.

The main body may be configured to support or protect a subject to be packaged. The main body may include a base plate 1, a first side plate 11*a*, a second side plate 11*b*, a third side plate 12*a*, and a fourth side plate 12*b*.

A shape of the base plate 1 may include a triangle, a quadrangle, a pentagon, an irregular shape, etc. The following descriptions are provided regarding the shape of the base plate 1 as the quadrangle unless otherwise stated. It should be noted that the descriptions of the quadrangle in the present disclosure are merely provided for illustration, and not intended to limit the scope of the present disclosure.

The base plate 1 may include a first side edge, a second side edge, a third side edge, and a fourth side edge in sequence. The first side edge and the second side edge may be two opposite side edges. The third side edge and the fourth side edge may be two opposite side edges. The first side plate 11*a*, the second side plate 11*b*, the third side plate 12*a*, and the fourth side plate 12*b* may be distributed beside the first side edge, the second side edge, the third side edge, and the fourth side edge of the base plate 1, respectively. The first side plate 11*a* may be disposed beside the first side edge, the second side plate 11*b* may be disposed beside the second side edge, the third side plate 12*a* may be disposed beside the third side edge, and the fourth side plate 12*b* may be disposed beside the fourth side edge.

In some embodiments, the base plate 1 and the fourth side plates may be an integrated structure. In other words, the base plate 1 and the fourth side plates (i.e., the first side plate 11*a*, the second side plate 11*b*, the third side plate 12*a*, and the fourth side plate 12*b*) may be formed by one plate (e.g., a paper card, or a sheet). For example, the main body 20 may include a center portion and an extension portion of the center portion along each of the first side edge, the second side edge, the third side edge, and the fourth side edge. The center portion may be the base plate 1. The extension portion of the center portion along the first side edge may form the first side plate 11*a*; the extension portion of the center portion along the second side edge may form the second side plate 11*b*; the extension portion of the center portion along the third side edge may form the third side plate 12*a*; the extension portion of the center portion along the fourth side edge may form the fourth side plate 12*b*.

In some embodiments, the fourth side plates may be physically connected with the base plate 1, such as via an adhesive, rivets, etc.

In some embodiments, the elastic sheet 2 may include a first fixing part and a second fixing part. The first fixing part of the elastic sheet 2 may be physically connected with the first side plate 11*a*, the second fixing part of the elastic sheet 2 may be physically connected with the second side plate 11*b*, and the elastic sheet 2 may cover at least a portion of the base plate 1. In some embodiments, the first side plate 11*a* may be connected with the first fixing part of the elastic sheet 2 and/or the second fixing part of the elastic sheet 2 may be connected with the second side plate 11*b* using an adhesive (e.g., a starch adhesive, a pressure sensitive adhesive, a hot melt adhesive, etc.), a staple, or the like, or any combination thereof.

In some embodiments, a space may be formed between the elastic sheet 2 and the base plate 1. The space may be used to accommodate the subject (e.g., a product). When the subject is packaged using the packaging apparatus, the first side plate 11*a* and the second side plate 11*b* may be folded relative to the base plate 1 toward the back side of the base plate 1. The third side plate 12*a* and the fourth side plate 12*b* may be folded to the front side of the base plate 1. The elastic sheet 2 may be stretched along the folding of the first side plate 11*a* and the second side plate 11*b*. The stretched elastic sheet 2 may position and/or immobilize the subject on the base plate 1.

In some embodiments, the first side plate 11*a* and the second side plate 11*b* may be folded to contact with the back side of the base plate 1 to form a cushion structure. For example, the first side plate 11*a* and the second side plate 11*b* may be folded toward the back side of the base plate 1 and physically connected or attached with the back side of the base plate 1.

In some embodiments, the second side plate 11*b* and the fourth side plate 12*b* may be folded substantially perpendicular to the base plate 1, and the second side plate 11*b* and the fourth side plate 12*b* may provide protection for the subject placed between the elastic sheet 2 and the base plate 1.

In order to further improve the fastening performance of the elastic sheet 2, one or more tensile holes may be disposed on the elastic sheet 2. When the elastic sheet 2 is stretched, the elastic sheet 2 may generate convex and/or concave around the tensile holes relative a surface of the elastic sheet 2, thereby increasing the roughness of the elastic sheet 2, and improving the fastening performance of the elastic sheet 2 for the subject.

A length of the elastic sheet 2 along a direction perpendicular to the first side edge or the second side edge may be determined according to a size, a specification, and/or a characteristic of the subject to be packaged. In some embodiments, the length of the elastic sheet 2 along the direction perpendicular to the first side edge may be greater than a length of the base plate 1 along the direction perpendicular to the first side edge. In some embodiments, the length of the elastic sheet 2 along the direction perpendicular to the first side edge may be less than or equal to a sum of lengths of the first side plate 11*a*, the second side plate 11*b*, and the base plate 1 along the direction perpendicular to the first side edge. In some embodiments, the length (also referred to as a width) of the elastic sheet 2 along the direction parallel to the first side edge or the second side edge may be less than or equal to a length of the base plate 1 along the direction parallel to the second side edge.

In some embodiments, the elastic sheet 2 may include one or more films with certain elasticity, such as a thermoplastic polyurethane elastomer (PE) rubber, a nylon film, a polyethylene plastic (PP) film, etc., which has the advantages of high strength, high toughness, and wear resistance, and may improve the fasten performance of the elastic sheet 2.

In some embodiments, the elastic sheet 2 may include one single film. In some embodiments, two opposite side edges of the film may be connected with the first side plate 11*a* and the second side plate 11*b*, respectively. In some embodiments, the other two opposite side edges of the film may be connected with the third side plate 12*a* and the fourth side plate 12*b*, respectively.

In some embodiments, the elastic sheet 2 may include two films, such as a first film and a second film. Two opposite side edges of the first film may connected with the first side plate 11*a* and the second side plate 11*b*, respectively. The first film may be stretched along the folding of the first side plate 11*a* and the second side plate 11*b*. Two opposite side edges of the second film may connected with the third side plate 12*a* and the fourth side plate 12*b*, respectively. The second film may be stretched along the folding of the third side plate 12*a* and the fourth side plate 12*b*. The stretched first film and the stretched second film may be overlapped partially and immobilize the subject cooperatively, which may improve the fasten performance of the elastic sheet 2.

In some embodiments, the elastic sheet 2 may include one or more sub-films. In some embodiments, each of the one or more sub-films may include a fixing part and a packaging part. The packaging parts of the sub-film may be contacted with a part (e.g., a key part) of the subject to immobilize or fix the product. The part of the subject may include at least one of a top corner, an edge, a center region, or the like, or any combination thereof, of the product. In some embodiments, the fixing part of each sub-film may be connected with two adjacent side plates among the first side plate 11*a*, the second side plate 11*b*, the third side plate 12*a*, and the fourth side plate 12*b*, respectively. The packaging part of each sub-film may correspond to a top corner of the base plate 1.

The count of the sub-films may be in a range from 1 to 4, and the fixing part of each of the sub-films may be located outside the base plate 1. When the elastic sheet 2 includes one sub-film, the sub-film may be fixed on the middle of the base plate 1 to fix a middle part of subject. When the elastic sheet 2 includes two sub-films, and the two sub-films may be fixed at two relative top corners of the base plate 1 to fix two relative corners of the subject. The two sub-films may be fixed at two sides of the base plate 1 to fix two sides of the subject. When the elastic sheet 2 includes three sub-films, the three sub-films may be fixed at three top corners of the base plate 1 to fix three corners of the subject. When the elastic sheet 2 includes four sub-films, the four sub-films may be fixed at four top corners of the base plate 1 to fix four corners of the subject.

Some embodiments of the present disclosure also provide a packaging carton based on the same inventive idea. The packaging carton may include a carton body and the packaging apparatus as described elsewhere in the present disclosure. The packaging apparatus may be placed in the packaging carton to fasten and protect the product.

Figure 2:
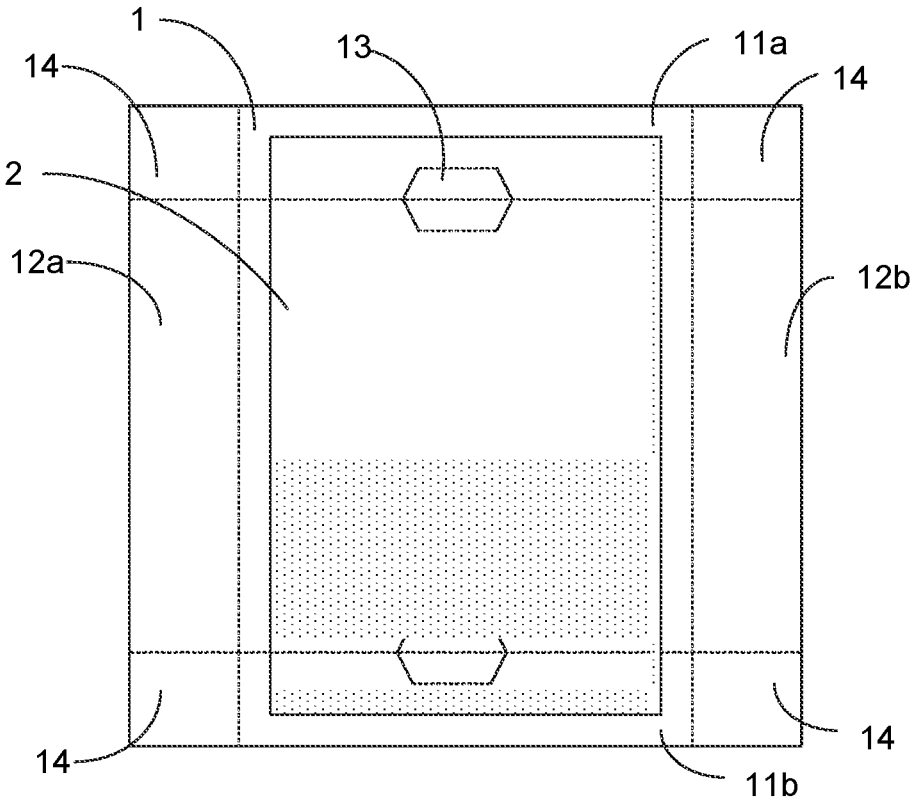
FIG. 2 is a schematic diagram illustrating a packaging apparatus with corner plates according to some embodiments of the present disclosure.

FIG. 2 is a schematic diagram illustrating an exemplary packaging apparatus according to some embodiments of the present disclosure. The difference between the packaging apparatus in FIG. 2 and the packaging apparatus in FIG. 1 may include that the packaging apparatus in FIG. 2 may further include one or more corner plates 14. The one or more corner plates 14 may be disposed between each two adjacent side plates among the first side plate 11*a*, the third side plate 12*a*, the second side plate 11*b*, and the fourth side plate 12*b*.

In some embodiments, the corner plates 14 may be physically connected with the first side plate 11*a*, the third side plate 12*a*, the second side plate 11*b*, and the fourth side plate 12*b*. When the first side plate 11*a*, the third side plate 12*a*, the second side plate 11*b*, and the fourth side plate 12*b* are folded, the corner plates 14 may be folded together with the side plates. For example, when the first side plate 11*a* and the second side plate 11*b* are folded toward the back side of the base plate 1, and the second side plate 11*b* and the fourth side plate 12*b* are folded toward the front side of the base plate 1, the corner plates 14 may be firstly folded together with the first side plate 11*a* and the second side plate 11*b* toward the back side of the base plate 1 and then folded together with the second side plate 11*b* and the fourth side plate 12*a* toward the front side of the base plate 1.

In some embodiments, the packaging apparatus may include one or more folding plates 13. In some embodiments, the folding plate(s) 13 may be disposed on the first side plate 11*a*, the third side plate 12*a*, the second side plate 11*b*, and/or the fourth side plate 12*b*. In some embodiments, the folding plate(s) 13 may be disposed on the base plate 1.

In some embodiments, the folding plate(s) 13 that are disposed between the base plate 1 and at least one side plate (e.g., the first side plate 11*a*, the third side plate 12*a*, the second side plate 11*b*, and/or the fourth side plate 12*b*). For example, the folding plate(s) 13 may be disposed between the first side plate 11*a* and the base plate 1 and/or between the second side plate 11*b* and the base plate 1. As another example, the folding plate(s) 13 may be disposed between the third side plate 12*a* and the base plate 1 and/or between the fourth side plate 12*b* and the base plate 1.

In some embodiments, as shown in FIG. 2, one or more cutting lines and/or one or more folding lines may be set on the base plate 1 and at least one of the first side plate 11*a*, the third side plate 12*a*, the second side plate 11*b*, and the fourth side plate 12*b*. The folding plate(s) 13 may be formed when the at least one side plate and/or the base plate 1 are folded along the one or more folding lines and/or cut along the one or more cutting lines. In a folded state, the folding plate(s) 13 may be folded between the base plate 1 and the at least one side plate, which may improve the cushion performance of the base plate 1. Specifically, the folding plate(s) 13 may be disposed between at least one side plate and the base plate 1. The folding plate(s) 13 may be folded towards the back side of the base plate 1 or the back side of the at least one side plate. In some embodiments, a count of the folding plate(s) 13 disposed between each of the at least one side plate and the base plate 1 may be determined according to actual conditions, which is not limited herein. For example, the count of the folding plate(s) 13 may be determined based on the size and/or the weight of the subject to be packaged. The greater the weight of the subject to be packaged is, the greater the count of the folding plate(s) 13 may be.

In some embodiments, the folding plate(s) 13 may be physically connected with the at least one side plate and the base plate 1. In some embodiments, the folding plate(s) 13 may be merely connected with the base plate 1, or the folding plate(s) 13 may be merely connected with the corresponding side plate. The corresponding side plate may refer to a side plate which may be provided with the folding plate(s) 13.

In some embodiments, at least one folding line and at least one cutting line may be disposed between the folding plate(s) 13 and the base plate 1, and between the folding plate(s) 13 and the corresponding side plate. The at least one cutting line may be connected with the at least one folding line, and the at least one cutting line and the at least one folding line may form an outline of the folding plate(s) 13.

In some embodiments, the at least one folding line may include a first folding line and a second folding line. The first folding line may be disposed between the folding plate(s) 13 and base plate 1, and the second folding line may be disposed between the folding plate(s) 13 and the corresponding side plate. In some embodiments, the at least one cutting line may be disposed between the folding plate and the base plate 1, and between the folding plate(s) 13 and the corresponding side plate. The at least one cutting line may be connected with the first folding line and the second folding line. When the folding line includes the first folding line and the second folding line, each of the at least one cutting line may include a straight line segment, a curved line segment, two independent straight line segments, or two independent curved line segments. When a count of the cutting line is two, two ends of one of the two cutting lines may be connected with an end of the first folding line and an end of the second folding line, respectively. Two ends of another cutting line may be connected with another end of the first folding line and another end of the second folding line, respectively. When the count of the at least one cutting line is one, two ends of the cutting line may be connected with the end of the first folding line and the end of the second folding line, respectively. Another end of the first folding line may be connected with another end of the second folding line. More descriptions for the folding plate(s) may be found elsewhere in the present disclosure (e.g., FIGS. 3A, 3B, 4A, and 4B and the descriptions thereof).

FIGS. 3A-3D are schematic diagrams illustrating a main body of a packaging apparatus according to some embodiments of the present disclosure. The packaging apparatus may be as described elsewhere in the present disclosure (e.g., FIGS. 1 and 2, and the descriptions thereof). The main body as shown in FIGS. 3A-3D may be the same as or similar to the main body as described in FIGS. 1 and 2. For example, the main body may include a base plate 1, a first side plate 11*a*, a second side plate 11*b*, a third side plate 12*a*, and a fourth side plate 12*b*. As another example, the main body may include a folding plate 13 that is disposed between a first side plate 11*a* and a base plate 1, and a folding plate 15 that is disposed between a second side plate 11*b* and the base plate 1. For the convenience of description, the folding plate 13 disposed between the first side plate 11*a* and the base plate 1 may be taken as an example. The folding plate 15 disposed between the second side plate 11*b* and the base plate 1 may be similar to or the same as the folding plate 13 disposed between the first side plate 11*a* and the base plate 1, which is not repeated herein.

Figure 3A:
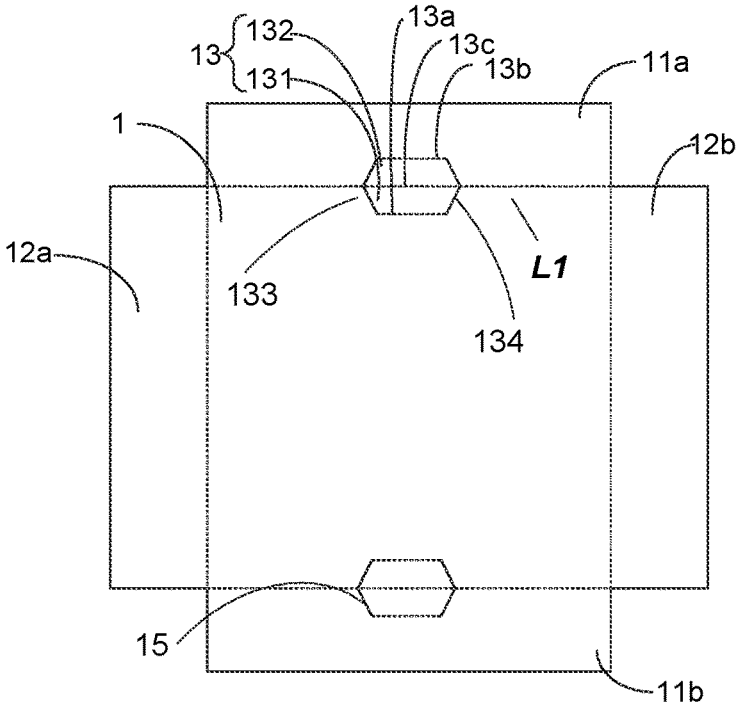
FIG. 3A is a schematic diagram illustrating a packaging apparatus after removing an elastic sheet according to some embodiments of the present disclosure.

In some embodiments, the folding plate 13 may be a portion of the base plate 1 and a portion of the first side plate 11*a*. The folding plate 13 may be formed based on one or more folding lines and one or more cutting lines set on the base plate 1 and the first side plate 11*a*. As shown in FIG. 3A, two cutting lines may be disposed between two side edges of the folding plate 13 that are parallel to the first side edge L1. Each of the two cutting lines may be connected the ends of the two side edges of the folding plate 13 that are parallel to the first side edge L1. The two cutting lines may be disposed between the folding plate 13, the base plate 1, and the first side plate 11*a*. The two cutting lines may include a first cutting line 133 and a second cutting line 134. The side edges of the folding plate 13 may be formed by cutting the base plate 1 and the first side plate 11*a* along the first cutting line 133 and the second cutting line 134. A first folding line 13*a* may be disposed at a junction of the folding plate 13 and the base plate 1, which may be used to guide the fold of the folding plate 13 relative to the base plate 1 along the first folding line 13*a*. A second folding line 13*b* may be disposed at a junction of the folding plate 13 and the first side plate 11*a*, which may be used to guide the fold of the folding plate 13 relative to the first side plate 11*a* along the second folding line 13*b*.

Alternatively, a central folding line 13*c* may be disposed between the first folding line 13*a* and the second folding line 13*b*. The folding plate 13 may be divided into a first folding portion 131 and a second folding portion 132 along the central folding line 13*c*. The first folding portion 131 and the second folding portion 132 may be folded in half along the central folding line 13*c*. In some embodiments, the central folding line 13*c* may be collinear with a folding line disposed between the first side plate 11*a* and the base plate 1, thereby improving the smooth of the boundary of the base plate 1 when the packaging apparatus is folded for packaging. In some embodiments, the central folding line 13*c* may be not collinear with the folding line disposed between the first side plate 11*a* and the base plate 1. A protruding structure may be formed when the first side plate 11*a* is folded, and the protruding structure may be configured to prevent a subject to be packaged from moving to an end of a packaging carton where the packaging apparatus is located and impacting the packaging carton when the packaging carton is hit.

In some embodiments, the first folding portion 131 and the second folding portion 132 may be symmetrical relative to the central folding line 13*c*, and accordingly, the first folding line 13*a* may be symmetrical to the second folding line 13*b* relative to the central folding line 13*c*. When the first folding portion 131 is symmetrical to the second folding portion 132 relative to the central folding line 13*c*, the first folding line 13*a* may be symmetrical to the second folding line 13*b* relative to the central folding line 13*c* as shown in FIG. 3A and/or FIG. 3C.

Figure 4A:
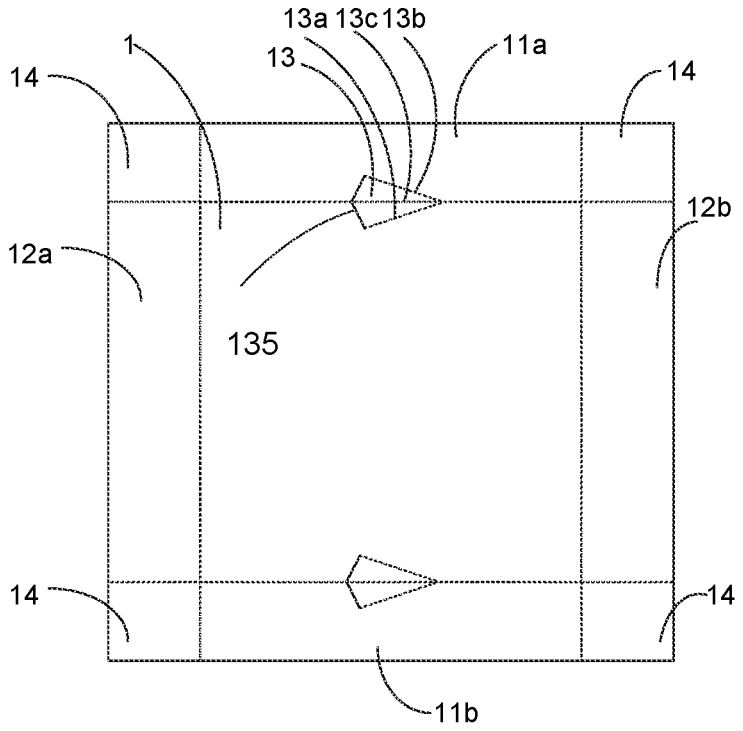
FIG. 4A is a schematic diagram illustrating a packaging apparatus after removing an elastic sheet according to some embodiments of the present disclosure.
Figure 4B:
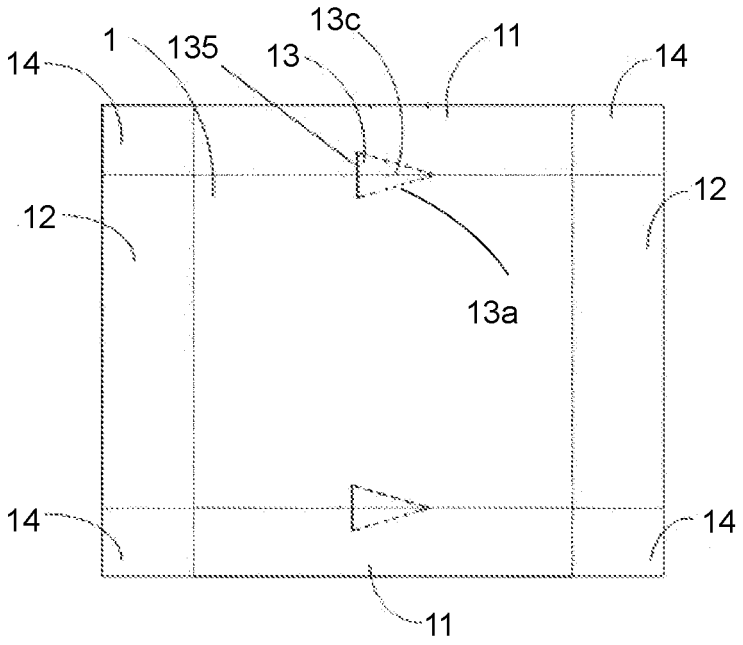
FIG. 4B is a schematic diagram illustrating a packaging apparatus after removing an elastic sheet according to some embodiments of the present disclosure.

In some embodiments, the first folding line 13*a* and the second folding line 13*b* may be parallel. In some embodiments, the first folding line 13*a* and the second folding line 13*b* may be not parallel with each other. For example, the first folding line 13*a* and the second folding line 13*b* may intersect and form an angle as shown in FIG. 4A and FIG. 4B. The first folding line 13*a* and the second folding line 13*b* may have an intersection at the first side edge of the base plate 1 or the central folding line 13*c* between the fist side plate 11*a* and the base plate 1.

As shown in FIG. 3A, the folding plate 13 may include the central folding line 13*c*, which may be disposed between the first folding line 13*a* and the second folding line 13*b*. When the first side plate 11*a* and the second side plate 11*b* are toward back side of the base plate 1, the base plate 1 and the first side plate 11*a* may be cut along the first cutting line 133 and the second cutting line 134. The first folding portion 131 and the second folding portion 132 of the folding plate 13 may be folded between the base plate 1 and the first side plate 11*a* along the first folding line 13*a*, the second folding line 13*b*, and the central folding line 13*c*. The first folding portion 131 and the second folding portion 132 may be folded in half along the central folding line 13*c* and stacked between the base plate 1 and the first side plate 11*a*. The first folding portion 131 may be relatively close to the base plate 1 than the second folding portion 132, and the second folding portion 132 may be relatively close to the first side plate 11*a* than the first folding portion 131. When the subject (e.g., a product) is packaged and placed between the base plate 1 and an elastic sheet (e.g., the elastic sheet 2 as described in FIG. 1), a four-layer structure may be formed under the subject, and the four-layer structure may include the base plate 1, the first folding portion 131, the second folding portion 132, and the first side plate 11*a*, which improves the support and cushioning of the package apparatus.

Figure 3B:
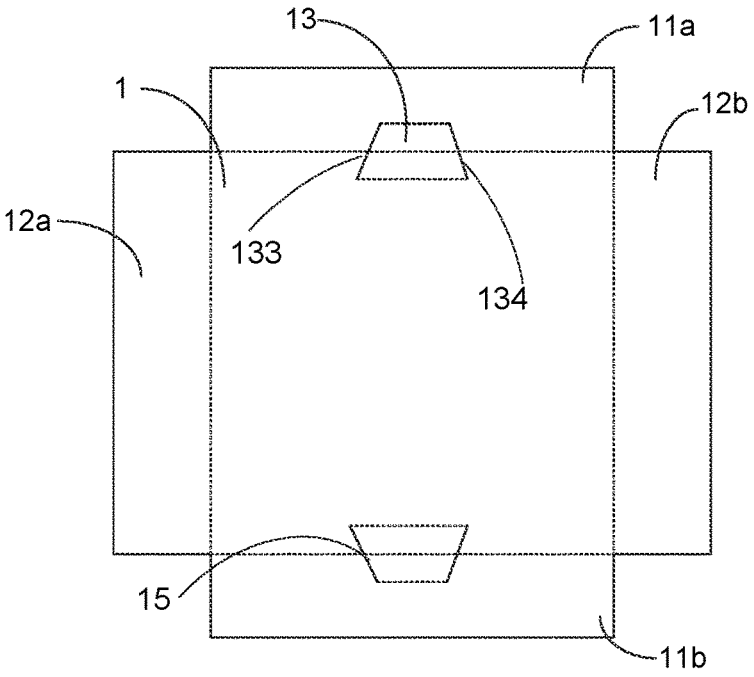
FIG. 3B is a schematic diagram illustrating a packaging apparatus after removing a film according to some embodiments of the present disclosure.
Figure 3C:
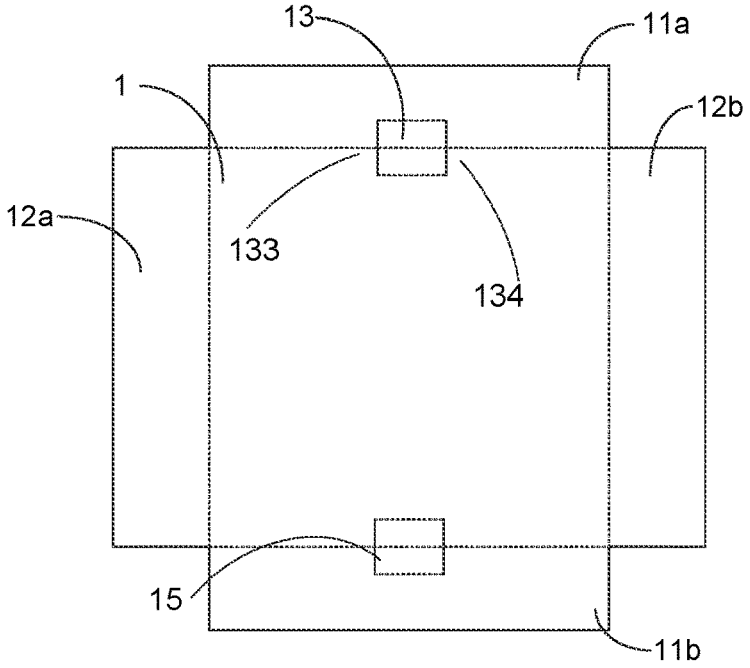
FIG. 3C is a schematic diagram illustrating a packaging apparatus after removing an elastic sheet according to some embodiments of the present disclosure.
Figure 3D:
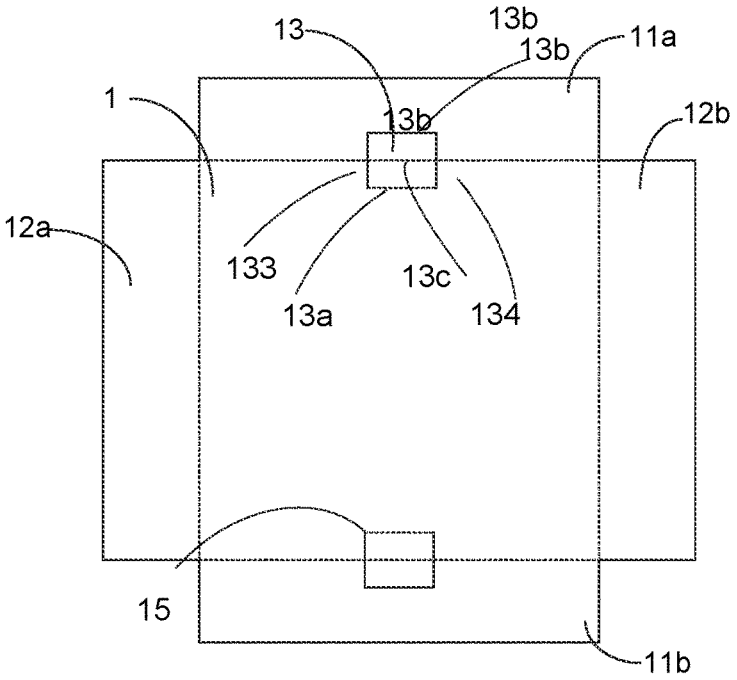
FIG. 3D is a schematic diagram illustrating a packaging apparatus after removing an elastic sheet according to some embodiments of the present disclosure.

In some embodiments, the shape of the folding plate 13 may be determined according to the one or more cutting lines. As shown in FIG. 3B, when the cutting line(s) includes two cutting lines, i.e., the first cutting line 133 and the second cutting line 134 each of which includes one single straight line segment, and the first cutting line 133 and the second cutting line 134 may be not parallel with each other, the shape of the folding plate 13 may be a quadrangle (e.g., a trapezoid). As shown in FIG. 3C, when the cutting line(s) includes two cutting lines, i.e., the first cutting line 133 and the second cutting line 134 each of which includes one single straight line segment parallel with each other, the shape of the folding plate 13 may be a quadrangle (e.g., a rectangle). The first cutting line 133 may be parallel to the second cutting line 134, and the first cutting line 133 and the second cutting line 134 may be perpendicular to the first folding line 13*a* and the second folding line 13*b*. As shown in FIG. 3A, when each of the first cutting line 133 and the second cutting line 134 includes two straight line segments, the shape of the folding plate 13 may be a hexagon. When the first cutting line 133 includes one straight line segment and the second cutting line includes two line segments, the shape of the folding plate 13 may be a pentagon.

In some embodiments, the cutting line(s) may include one single cutting line set at one side of the folding plate 13. When the cutting line set at one side of the folding plate 13 is a straight line segment, the shape of the folding plate 13 may be a triangle as shown in FIG. 4B. When the cutting line set at one side of the folding plate 13 includes two line segments, the shape of the folding plate 13 may be a quadrangle as shown in FIG. 4A.

In some embodiments, one of the first folding line 13*a* and the second folding line 13*b* may be a cutting line (i.e., a third cutting line). As show in FIG. 3D, the second folding line 13*b* may be set as a cutting line. The folding plate 13 may be formed by cutting the base plate 1 and the first side plate 11*a* along the first cutting line 133, the second cutting lien 134, and the third cutting line. Then the folding plate 13 may be folded along the first folding line 13*a* and/or the central folding lien 13*c*.

FIGS. 4A-4B are schematic diagrams illustrating a main body of a packaging apparatus according to some embodiments of the present disclosure. The packaging apparatus may be as described elsewhere in the present disclosure (e.g., FIGS. 1 and 2, and the descriptions thereof). The main body as shown in FIGS. 4A-4B may be the same as or similar to the main body as described in FIGS. 1 and 2. For example, the main body may include a base plate 1, a first side plate 11*a*, a second side plate 11*b*, a third side plate 12*a*, and a fourth side plate 12*b*. As another example, the main body may include a folding plate 13. Compared with the folding plate 13 as described in FIGS. 3A-3D, as shown in FIG. 4A and FIG. 4B, a cutting line 135 may be disposed at only one side of the folding plate 13. An end of a first folding line 13*a* and an end of a second folding line 13*b* may be connected with two ends of the cutting line cutting line 135 as shown in FIGS. 4A and 4B, respectively. Another end of a first folding line 13*a* may be connected with another end of a second folding line 13*b*. In other words, the first folding line 13*a* and the second folding line 13*b* may be intersected. As shown in FIG. 4A, the cutting line 135 may include two line segments, and the shape of the folding plate 13 may be a quadrangle. As shown in FIG. 4B, the cutting line 135 may include one single line segment, and the shape of the folding plate 13 may be a triangle.

As shown in FIG. 4A, the cutting line 135 may be set at only one side of the folding plate 13, a first portion of which may be set on the base plate 1 and a second portion of which may be set on the first side plate 11*a* as indicated by two solid line segments on the left side of the folding plate 13. The first portion of the cutting line 135 and the second portion of the cutting line 135 may be not collinear. The first folding line 13*a* between the folding plate 13 and the base plate 1 may be symmetrical to the second folding line 13*b* between the folding plate 13 and the first side plate 11*a* relative to the central folding line 13*c*. An angle may be formed between the first folding line 13*a* and the second folding line 13*b*.

As shown in FIG. 4B, the cutting line 135 may be set at only one side of the folding plate 13, a first portion of which may be set on the base plate 1 and a second portion of which may be set on the first side plate 11*a* as indicated by two solid line segments on the left side of the folding plate 13. The first portion of the cutting line 135 and the second portion of the cutting line 135 may be collinear. The first folding line 13*a* between the folding plate 13 and the base plate 1 may be symmetrical to the second folding line 13*b* between the folding plate 13 and the first side plate 11*a* relative to the central folding line 13*c*. An angle may be formed between the first folding line 13*a* and the second folding line 13*b*.

In some embodiments, when the folding plate 13 is connected with one of the base plate 1 and the first side plate 11*a*, the folding plate 13 may be not disposed between the base plate 1 and the first side plate 11*a*, and the folding plate 13 may be disposed on the base plate 1 or the first side plate 11*a*. For example, a folding line and a cutting line may be disposed between the folding plate 13 and the base plate 1. The cutting line may include two line segments which are not collinear. The folding line may include a straight line segment. The folding plate 13 may be folded to the back side of the base plate 1 along the folding line, and a layer structure may be added between the base plate 1 and the first side plate 11*a*.

In some embodiments, when the folding plate 13 is connected with one of the base plate 1 and the first side plate 11*a*, one or more central folding lines may be disposed on the folding plate 13. The folding plate 13 may be divided into two or more folding subplates. The two or more folding subplates may be folded along the central folding lines, and a multi-layer structure with two or more layers may be formed between the base plate 1 and the first side plate 11*a*.

In some embodiments, when the folding plate 13 is connected with the base plate 1 and the first side plate 11*a*, the folding plate 13 may include the first folding line 13*a* and the second folding line 13*b*. One or more central folding lines 13*c* may be disposed between the first folding line 13*a* and the second folding line 13*b*. The folding plate 13 may be divided into three or more folding subplates, a multi-layer structure with three or more layers may be formed between the base plate 1 and the first side plate 11*a*.

The shape of the folding plate 13 is not limited to the shape(s) mentioned above. The shape of the folding plate 13 may include various shapes, which may cause the first folding portion 131 and the second folding portion 132 of the folding plate 13 to be folded between the first side plate 11*a* and the base plate 1, and a multi-layer structure with two or more layers may be formed between the base plate 1 and the first side plate 11*a*.

In some embodiments, a multi-layer (e.g., even-layer) structure may be formed between the base plate 1 and the first side plate 11*a*.

In some embodiments, the package apparatus may not include the folding plate. One or more elastic pads or elastic supports may be disposed between the base plate 1 and the first side plate 11*a*, or on a lower side of the first side plate 11*a* which may be folded to the back side of the base plate 1.

Figure 5A:
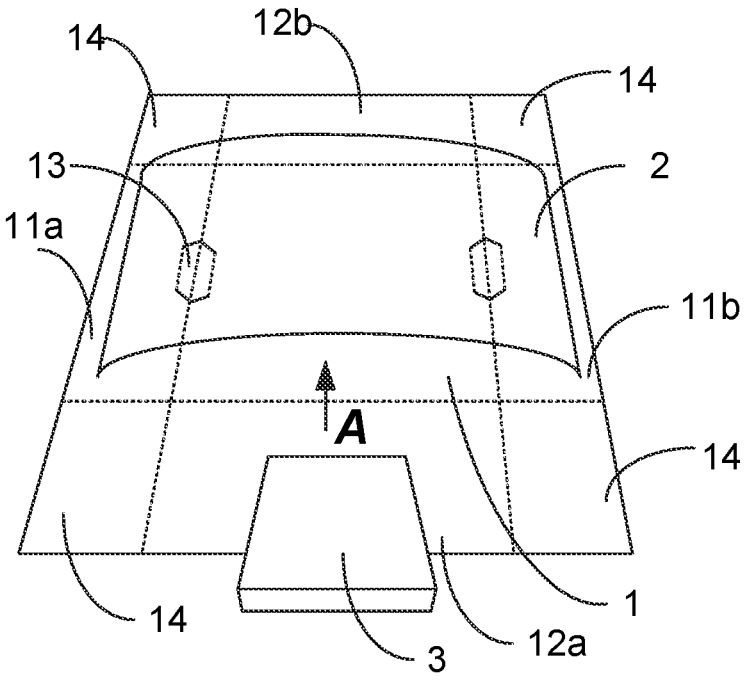
FIGS. 5A-5F are schematic diagrams illustrating a packaging process using a packaging apparatus according to some embodiments of the present disclosure.
Figure 5B:
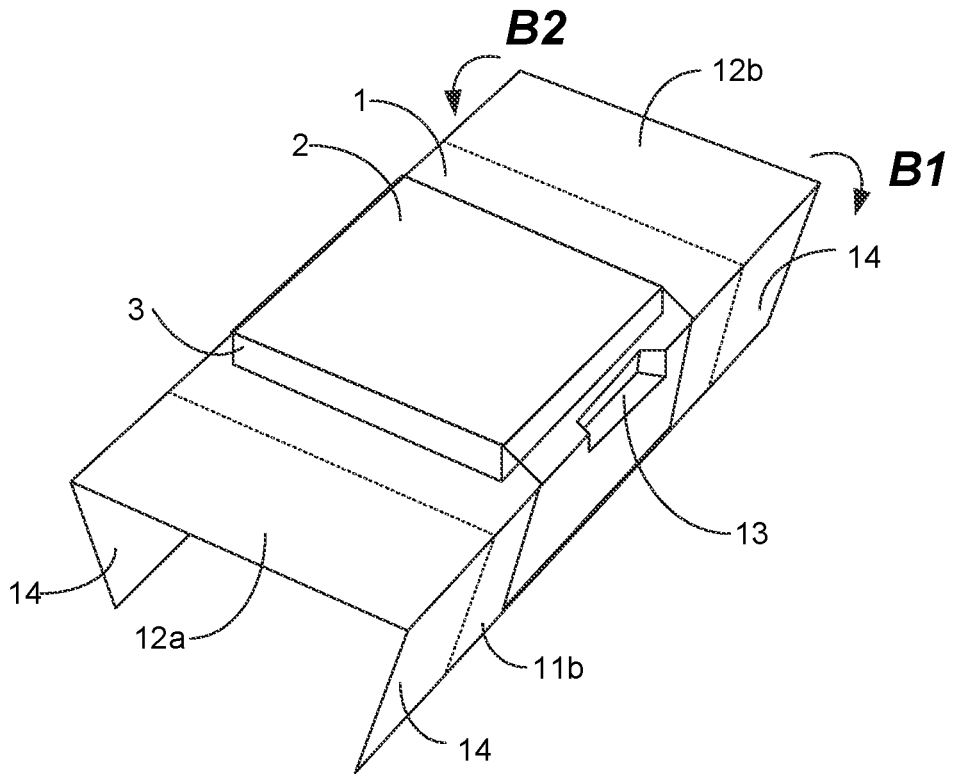
Figure 5C:
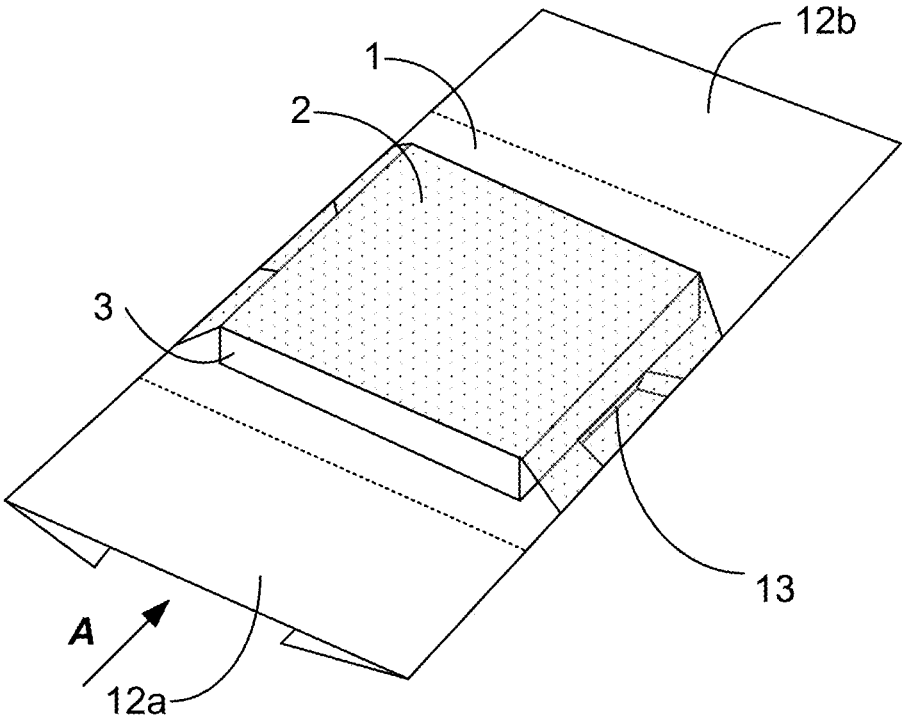

FIGS. 5A-5F are schematic diagrams illustrating a process for packaging a subject using a package apparatus according to some embodiments of the present disclosure. Taking the packaging apparatus as shown in FIG. 2 as an example, a process of packaging a subject 3 may be described referring to FIGS. 5A-5F. As shown in FIG. 5A, the subject 3 may be placed in a space formed between the elastic sheet 2 and the base plate 1 along a direction as denoted by an arrow A. As shown in FIG. 5B, the first side plate 11*a* and the second side plate 11*b* may be folded toward the back side of the base plate 1 as indicated by arrows 81 and 82. As shown in 5C, at least a portion of the first side plate 11*a* and the second side plate 11*b* may be folded to contact with the base plate 1. The elastic sheet 2 may be stretched along the folding of the first side plate 11*a* and the second side plate 11*b* to immobilize the subject 3 on the base plate 1.

Figure 5D:
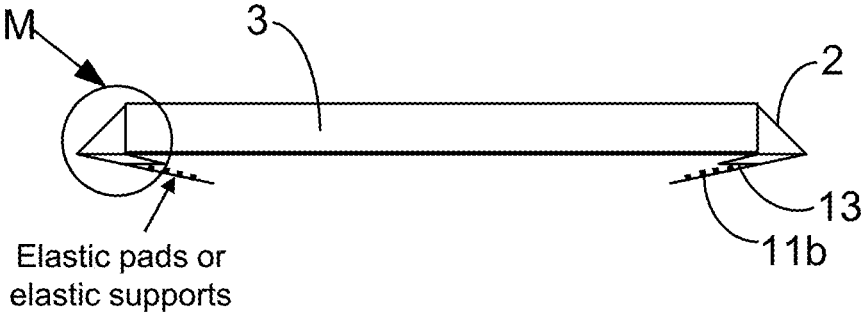
Figure 5E:
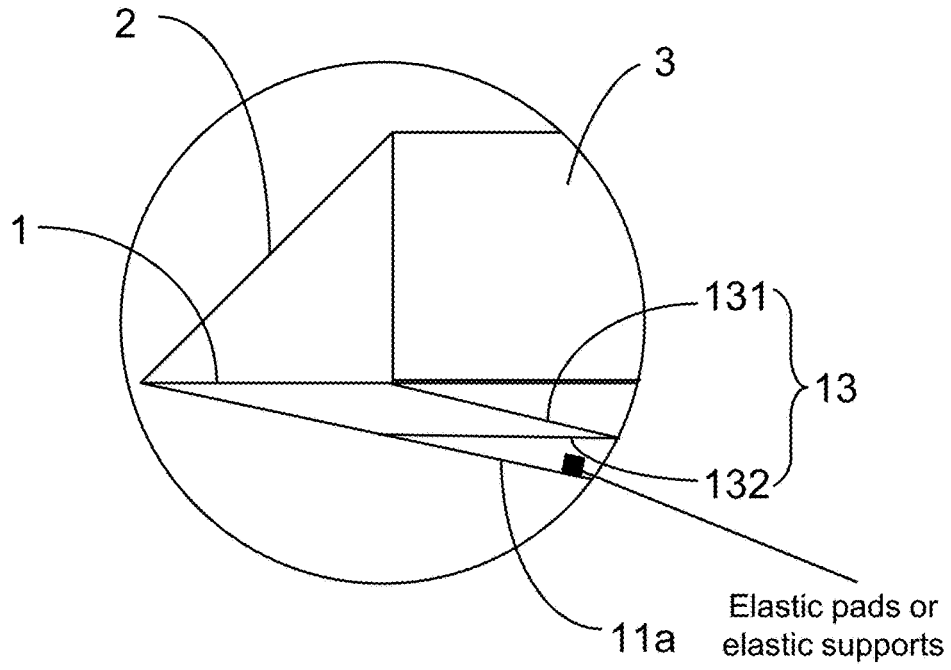

FIG. 5D is a schematic diagram illustrating the side projection of the packaging apparatus from a direction indicated by arrow A' according to some embodiments of the present disclosure. FIG. 5E is an enlarged portion in a circle M as shown in FIG. 5D. As shown in FIG. 5E, the first folding portion 131 and the second folding portion 132 of the folding plate 13 may be folded in half between the base plate 1 and the first side plate 11*a*. The first folding portion 131 may be close to the base plate 1 relative to the second folding portion 132, and the second folding portion 132 may be close to the first side plate 11*a* relative to the first folding portion 132. A four-layer structure may be formed under the subject 3. The four-layer structure may include the base plate 1, the first folding portion 131, the second folding portion 132, and the first side plate 11*a* arranged from a top to a bottom of the four-layer structure. Two ends of the elastic sheet 2 may be connected with the first side plate 11*a* and the second side plate 11*b*, respectively, and the elastic sheet 2 may be stretched in the process of packaging the subject 3 or when the first side plate 11*a* and the second side plate 11*b* are folded toward the back side of the base plate 1. The elastic potential energy of the stretched elastic sheet 2 may press the subject 3 to the base plate 1 and limit a position of the subject 3. The elastic sheet 2 and the base plate 1 may perform a fastening function on the subject 3.

Figure 5F:
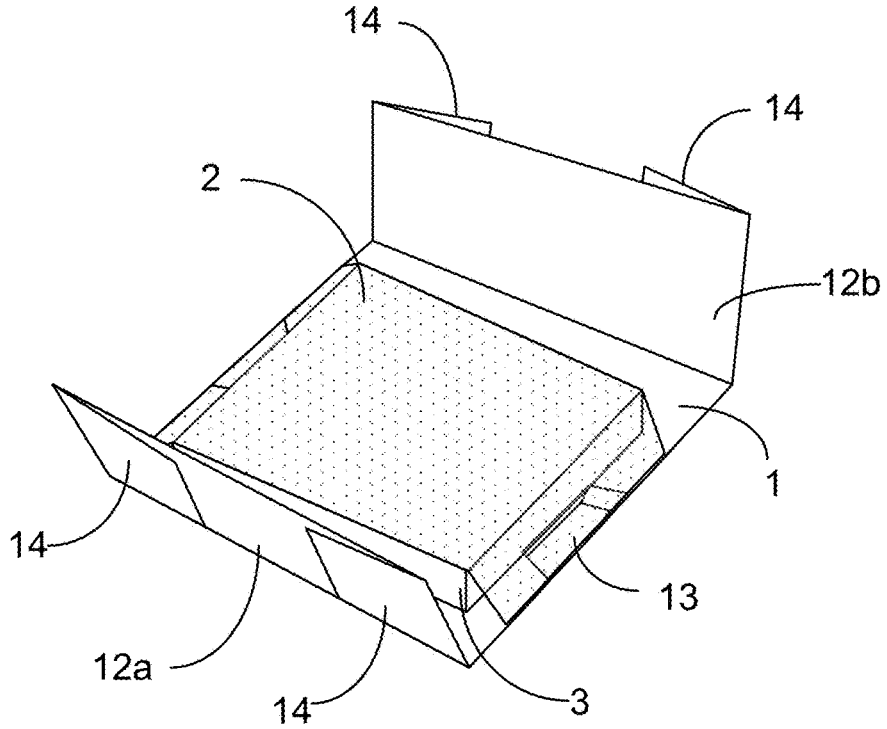

As shown in FIG. 5F, the third side plate 12*a* and the fourth side plate 12*b* may be folded toward the front side of the base plate 1. The folded third side plate 12*a* and the fourth side plate 12*b* may be perpendicular to (or substantially perpendicular to) the base plate 1 along a side of the base plate 1. The third side plate 12*a* and the fourth side plate 12*b* may be extended upward along the surface of the base plate 1. In the folded state of the packaging apparatus, the folded third side plate 12*a*, the folded fourth side plate 12*b* may form two side walls of the packaging apparatus and the base plate 1 may form a bottom of the packaging apparatus. The folded third side plate 12*a*, the folded fourth side plate 12*b*, and the base plate 1 may form a space to protect the subject 3.

It can be seen that the folding plate 13 may be located between the base plate 1 and the first side plate 11*a* of the packaging apparatus. The first folding portion 131 and the second folding portion 132 of the folding plate 13 may be folded and stacked between the base plate 1 and the first side plate 11*a* during the process of packaging the subject 3, thereby improving the strength of a bottom of the packaging apparatus, providing stable protection for the subject 3, and reducing the strength of an impact to the subject 3 during the transportation or testing of the subject 3. In addition, the manufacture and application of the packaging apparatus may not increase the material cost and the labor cost of the packaging process. The packaging apparatus may have a simple structure, cost relatively low, etc., and may be applied for many packaging occasions, which may have a development prospect.

In some embodiments, multiple folding plates may be disposed between at least one of the side plates (e.g., the first side plate 11*a*, the second side plate 11*b*, the third side plate 12*a*, and the fourth side plate 12*b*) and the base plate 1.

Figure 6:
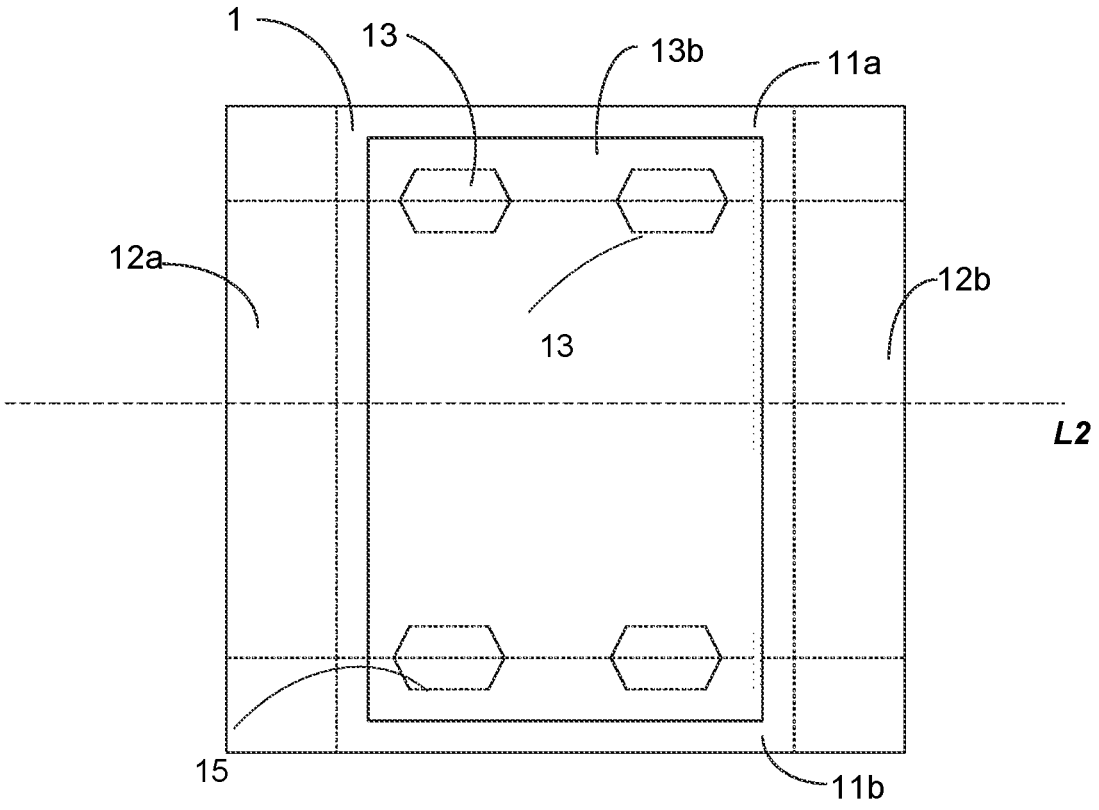
FIG. 6 is a schematic diagram illustrating a packaging apparatus according to some embodiments of the present disclosure.

FIG. 6 is a schematic diagram illustrating an exemplary packaging apparatus according to some embodiments of the present disclosure. The packaging apparatus may be as described elsewhere in the present disclosure (e.g., FIG. 2, and the descriptions thereof). The main body as shown in FIG. 6 may be the same as or similar to the main body as described in FIG. 2. For example, the main body may include a base plate 1, a first side plate 11*a*, a second side plate 11*b*, a third side plate 12*a*, and a fourth side plate 12*b*. Compared with the main body as shown in FIG. 2, the main body as shown in FIG. 6 may include multiple folding plates 13 disposed between the first side plate 11*a* and the base plate 1. The main body as shown in FIG. 6 may also include multiple folding plates 15 disposed between the second side plate 11*b* and the base plate 1.

In some embodiments, the folding plates 13 disposed between the first side plate 11*a* and the base plate 1 and the folding plates 15 disposed between the second side plate 11*b* and the base plate 1 may be distributed symmetrically relative to a center line denoted by dotted line L2. Each of the folding plates 13 disposed between the first side plate 11*a* and the base plate 1 may correspond to one of the folding plates 15 disposed between the second side plate 11*b* and the base plate 1, which may further improve the strength and cushion of the bottom portion of the packaging apparatus. In other words, each of the folding plates 13 disposed between the first side plate 11*a* and the base plate 1 and one of the folding plates 15 disposed between the second side plate 11*b* and the base plate 1 may be symmetrical relative to the center line of the base plate 1 as denoted by dotted line L2. In some embodiments, the folding plates 13 disposed between the first side plate 11*a* and the base plate 1 and the folding plates 15 disposed between the second side plate 11*b* and the base plate 1 may be arranged in a staggered manner. In other words, the folding plates 13 disposed between the first side plate 11*a* and the base plate 1 and the folding plates 15 disposed between the second side plate 11*b* and the base plate 1 may be arranged asymmetrically relative to the center line of the base plate 1 as denoted by dotted line L2.

For a packaging apparatus with a film and a paper card, a subject may be placed between the film and the paper card, and a frictional force may be generated between the subject and the paper card to immobilize the subject. However, the anti-friction ability of the paper card is relatively weak. When an impact occurs instantly during the transportation or testing of the subject, the frictional force may not capable of immobilizing the product, and the subject may move in a packaging carton where the packaging apparatus is located. When the subject impacts the packaging carton, the packaging carton may be damaged. The packaging apparatus mentioned above may improve the strength of the bottom of the packaging apparatus. Some embodiments of the present disclosure may also provide a packaging apparatus which may be used to prevent the subject from impacting the packaging carton and damaging the packaging carton. According to some embodiments of the present disclosure, the base plate may be designed, so that when the packaging apparatus is folded, one or more protrusions may be formed beside one or more side edges of the base plate of the packaging apparatus, thereby providing a cushioning protect for the subject from the side of the base plate.

As described elsewhere in the present disclosure, the base plate 1 may include the first side plate 11*a*, the second side plate 11*b*, the third side plate 12*a*, and the fourth side plate 12*b*, which may be distributed around the base plate 1. The elastic sheet 2 may be connected with the first side plate 11*a* and the second side plate 11*b*. The elastic sheet 2 may be configured to immobilize or fasten a subject when the elastic sheet 2 is stretched by folding the first side plate 11*a* and the second side plate 11*b* towards the back side of the base plate 1.

In some embodiments, the packaging apparatus may further include one or more protruding plates disposed along the first side edge and/or the second side edge of the base plate 1. Each of the one or more protruding plates may include at least one of a first protruding plate or a second protruding plate. The first protruding plate may be protruded along the first side edge (or the second side edge) of the base plate 1. The second protruding plate may be protruded along the third side edge or the fourth side edge of the base plate 1.

In some embodiments, the first side plate (or the second side plate) may include a hole or notch corresponding to the first protruding plate. An edge of the hole or notch may conform an edge of the first protruding plate. The first protruding plate may be embedded into the hole or notch.

In some embodiments, the first protruding plate and the base plate 1, and/or the first side plate 11*a* may be an integrated structure. In other words, the first protruding plate and the base plate 1, and/or the first side plate 11*a* may be formed by one single plate (e.g., a paper card or a sheet). For example, a cutting line may be disposed on the first side plate 11*a*. The first protruding plate and the hole or notch on the first side plate 11*a* may be formed by cutting the first side plate 11*a* along the cutting line. When the first side plate 11*a* is folded, the hole or notch may occur on the first side plate 11*a*, which may conform a shape of the first protruding plate. In some embodiments, the first side plate 11*a* and/or the second side plate 11*b* may not include the hole or notch, and the first protruding plate may be physically connected with the base plate 1 or the first side plate 11*a*. The first side plate 11*a* and the first protruding plate may form a two-layer structure. More descriptions for the protruding plate may be found in FIGS. 7A-11D.

FIGS. 7A-7D are schematic diagram illustrating exemplary packaging apparatuses according to some embodiments of the present disclosure. The packaging apparatus may be as described elsewhere in the present disclosure (e.g., FIGS. 1 and 2, and the descriptions thereof). For example, the packaging apparatus may include a main body and an elastic sheet 2. The main body as shown in FIGS. 7A-7D may be the same as or similar to the main body as described in FIGS. 1 and 2. For example, the main body may include a base plate 1, a first side plate 11*a*, a second side plate 11*b*, a third side plate 12*a*, and a fourth side plate 12*b*. The shape of the base plate 1 may be a quadrangle. The base plate 1 may include a first side edge, a third side edge, a second side edge, and a fourth side edge. The first side edge and the second side edge may be disposed relative to each other. The third side edge and the fourth side edge may be disposed relative to each other.

The multiple side plates may be arranged on the side edges of the base plate 1. For example, the first side plate 11*a* and the second side plate 11*b* may be disposed beside and physically connected with the first side edge and the second side edge, respectively. The third side plate 12*a* and the fourth side plate 12*b* may be disposed beside and physically connected with the third side edge and the fourth side edge, respectively. As another example, the base plate 1 may be extended along the fourth side edges to form the first side plate 11*a*, the third side plate 12*a*, the second side plate 11*b*, and the fourth side plate 12*b*. The base plate 1, the first side plate 11*a*, the third side plate 12*a*, the second side plate 11*b*, and the fourth side plate 12*b* may be an integrated structure.

The elastic sheet 2 may be disposed above the base plate 1 (i.e., the front side of the base plate 1). In some embodiments, the elastic sheet 2 may include a first fixing part and a second fixing part. The first fixing part of the elastic sheet 2 may be connected with the first side plate 11*a*, The second fixing part may be connected with the second side plate 11*b*, and a space may be formed between the elastic sheet 2 and the front side of the base plate 1, which may be used to accommodate the subject 3. When packaging the subject 3, the first side plate 11*a* and the second side plate 11*b* may be folded toward the back side of the base plate 1. The third side plate 12*a* and the fourth side plate 12*b* may be folded toward the front of the base plate 1 to be substantially perpendicular to the base plate 1 relative to the base plate 1, thereby protecting the subject 3. In a plane parallel to the base plate 1, the third side plate 12*a* and the fourth side plate 12*b* may protect the subject 3 in a first direction. As used herein, the first direction refers to a direction perpendicular to the third side edge or fourth side edge of the base plate 1 and parallel to the base plate 1.

In order to protect the subject 3 during transportation of the subject 3 in a second direction perpendicular to the first direction and parallel to the base plate 1 and prevent the subject 3 from moving and impacting the packaging carton, one or more protruding plates may be formed on the packaging apparatus along the second direction. The protruding plate(s) may be protruded out of the packaging apparatus from at least one side plate after the first side plate 11*a*, the third side plate 12*a*, the second side plate 11*b*, and the fourth side plate 12*b* are folded. The protruding plate(s)

may contact a body (e.g., a side wall) of the packaging carton to protect the subject 3 in the second direction. The second direction may refer to a direction perpendicular to the first side edge of the base plate 1 and parallel to the base plate In some embodiments, when the first side plate 11*a* and the second side plate 11*b* are folded toward the back side of the base plate 1, the first side edge (or the second side edge) of the base plate 1 may be protruded and form a first protruding plate 111. When the first side plate 11*a* and the second side plate 12*a* are tiled, the first protruding plate 111 may be overlapped with the first side plate 11*a*(or the second side plate 11*b*), or not overlapped with the first side plate 11*a* (or the second side plate 11*b*). The first protruding plate 111 being overlapped with the first side plate 11*a* (or the second side plate 11*b*) may refer to that when the first side plate 11*a* and the second side plate 11*b* are tiled, the first protruding plate 111 may have no nesting relationship with the first side plate 11*a* (or the second side plate 11*b*), and the protruding plate 111 and the first side plate 11*a* (or the second side plate 11*b*) may form a two-layer structure, i.e., the first side plate 11*a* and the first protruding plate 111 may be stacked together. The protruding plate 111 not being overlapped with the first side plate 11*a* (or the second side plate 11*b*) may refer to that the first protruding plate 111 may be embedded in the first side plate 11*a* (or the second side plate 11*b*) to form a single-layer structure, that is, a hole or a notch may be disposed on the first side plate 11*a* (or the second side plate 11*b*) that conforms the first protruding plate 111 and is configured to accommodate the first protruding plate 111.

In some embodiments, the base plate 1 may be extended to form two protruding plates that are located at two sides of the base plate 1. The protruding plates and the base plate 1 may be an integrated structure. The first side plate 11*a* may be physically connected with the base plate 1, such as by adhesive. For example, the first protruding plate 111 and the first side plate 11*a* may be stacked to form a two-layer structure.

In some embodiments, the protruding plates, the base plate 1, and the first side plates 11*a* may be an integrated structure. For example, a cutting line 111*a* may be set on the first side plate 11*a* (or the second side plate 11*b*). The first side plate 11*a* may be cut along the cutting line 111*a* to form the first protruding plate 111. When the first side plate 11*a* is folded toward the back side of the base plate 1, the first protruding plate 111 may be formed along the cutting line 111*a*.

When the first side plate 11*a* is folded toward the back side of the base plate 1, the first protruding plate 111 may be not folded along the first side plate 11*a*. The elastic sheet 2 may be stretched along the folding of the first side plate 11*a* and the second side plate 11*b*. The subject 3 may be placed at a center region of the base plate 1. In a left-right direction shown in FIG. 7A (i.e., a direction perpendicular to a direction indicated by the arrow C in FIG. 7A), the third side plate 12*a* and the fourth side plate 12*b* may be folded toward the front side of the base plate 1 (i.e., away from the back side of the base plate 1) to protect the subject 3. During the transportation or testing of the subject 3, the first protruding plate 111, the third side plate 12*a*, and the fourth side plate 12*b* may contact the packaging carton. If the subject 3 moves, the subject 3 may not impact the body of the packaging carton.

Figure 7A:
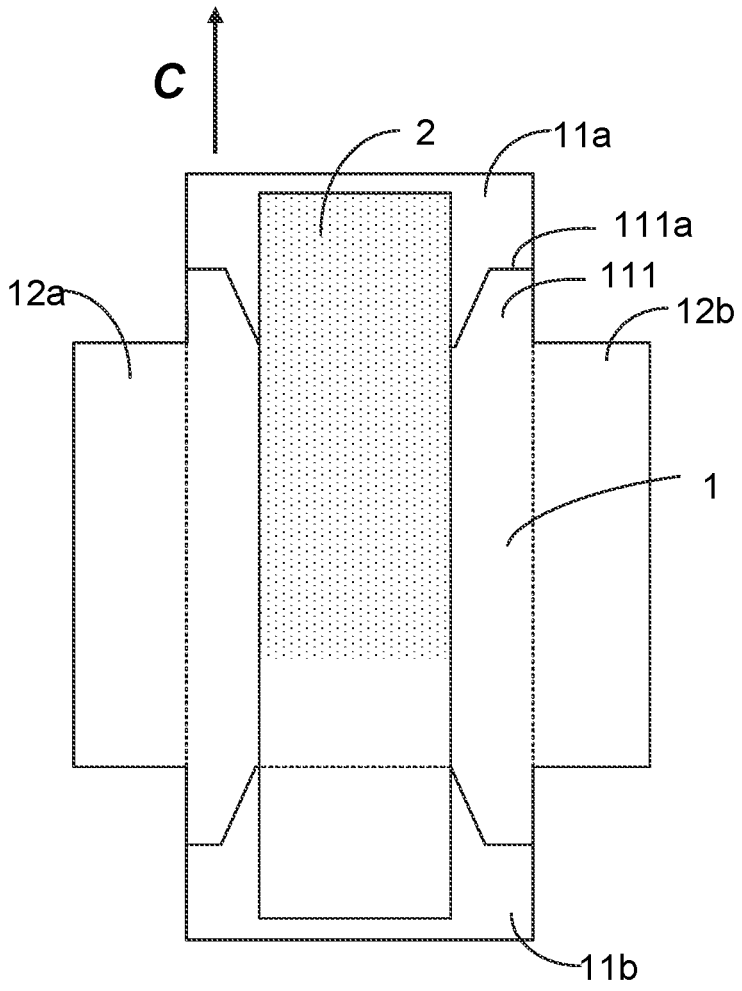
FIG. 7A is a schematic diagram illustrating a packaging apparatus according to some embodiments of the present disclosure.
Figure 7B:
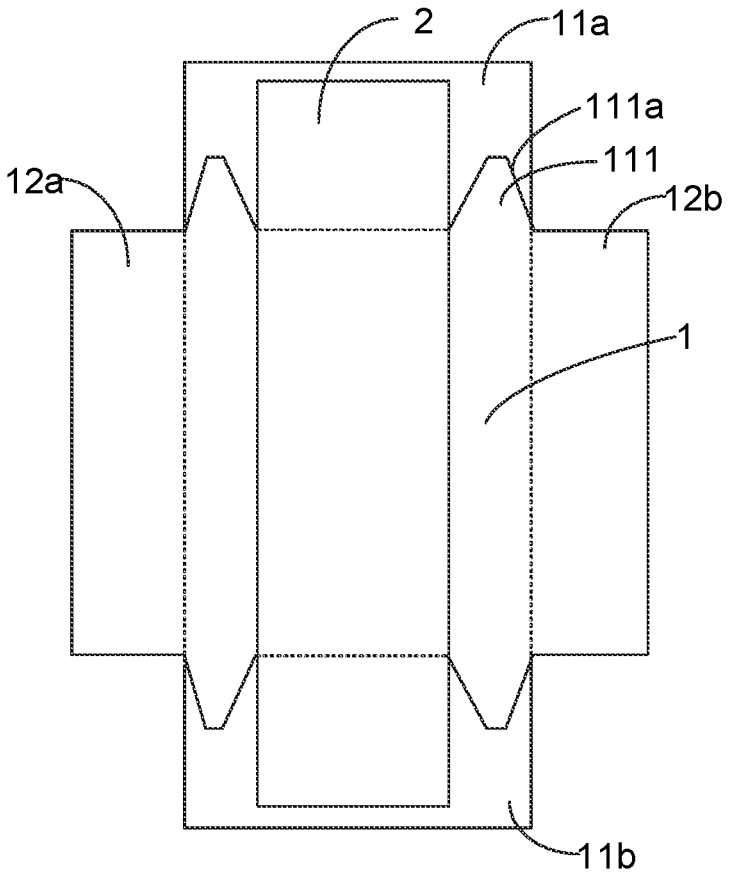
FIG. 7B is a schematic diagram illustrating a packaging apparatus according to some embodiments of the present disclosure.
Figure 7C:
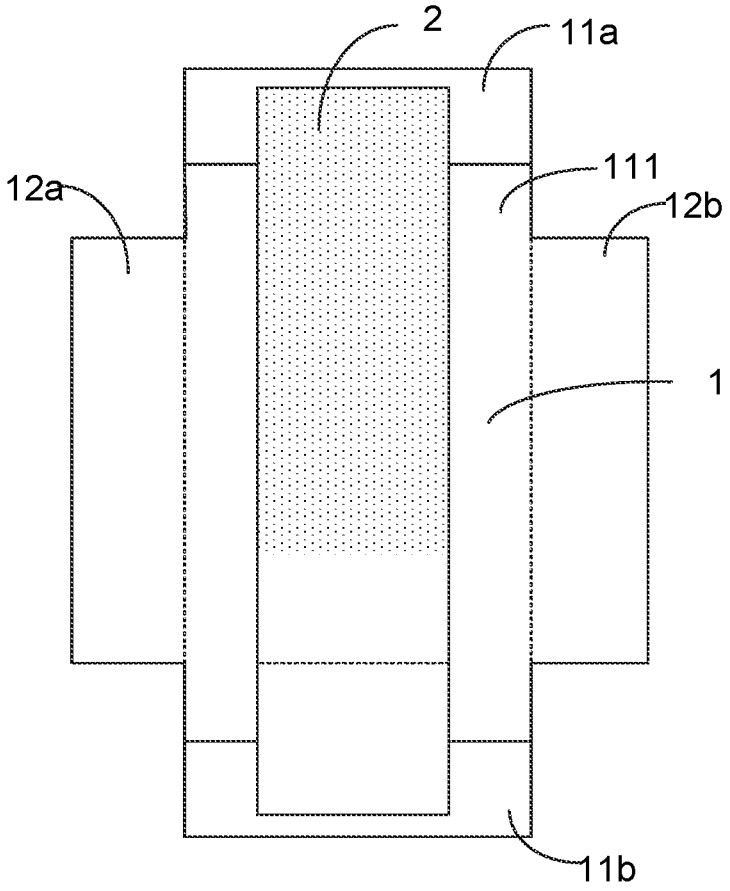
FIG. 7C is a schematic diagram illustrating a packaging apparatus according to some embodiments of the present disclosure.

In some embodiments, the shape of the first protruding plate 111 may include a quadrangle or a triangle. In some embodiments, the shape of the first protruding plate 111 may include a zigzag, a circular, an irregular shape, or the like, that may isolate the base plate 1 with the packaging carton where the packaging apparatus is located and ensure that the subject 3 may not impact the packaging carton. Preferably, the shape of the protruding plate 111 may be the quadrangle. As shown in FIG. 7A, the shape of the first protruding plate 111 may be a right trapezoid. When the packaging apparatus is folded, the shape of a hole or notch on the first side plate 11*a* may be a right trapezoid that conforms the shape of the first protruding plate 111. As shown in FIG. 7B, the shape of the first protruding plate 111 may be an ordinary trapezoid. As shown in FIG. 7C, the shape of the first protruding plate 111 may be a rectangle.

Figure 7D:
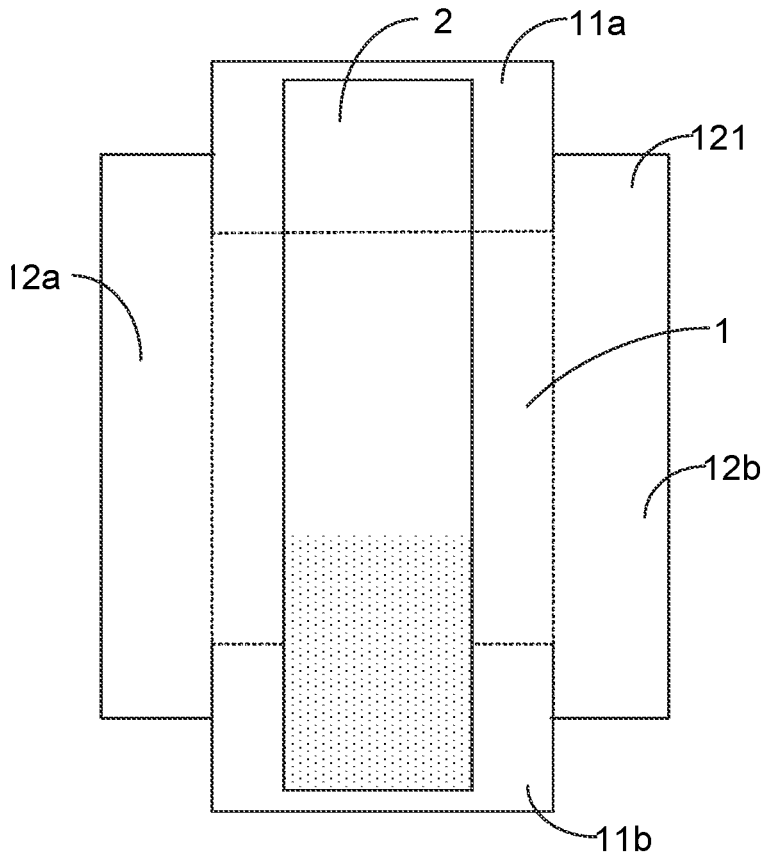
FIG. 7D is a schematic diagram illustrating a packaging apparatus according to some embodiments of the present disclosure.

In some embodiments, as shown in FIG. 7D, the fourth side plate 12*b* (and/or the third side plate 12*a*) may be protruded relative to the base plate 1 to form a second protruding plate 121. In some embodiments, the second protruding plate 121 may perform a function the same as or similar to a function performed by the first protruding plate 111 as described in FIG. 7A. The shape of the second protruding plate 121 may be various (e.g., a rectangular as shown in FIG. 7D), which may be the same as or similar to the shape of the first protruding plate 111, which is not repeated herein.

In some embodiments, the second protruding plate 121 and the fourth side plate 12*b* may be an integrated structure. When the first side plate 11*a* and the second side plate 11*b* are folded toward the back side of the base plate 1, the fourth side plate 12*b* may protrude relative to the base plate 1. The protrude portion of the fourth side plate 12*b* may refer to the second protruding plate 121.

In some embodiments, the second protruding plate 121 may be physically connected with the fourth side plate 12*b*.

Figure 8:
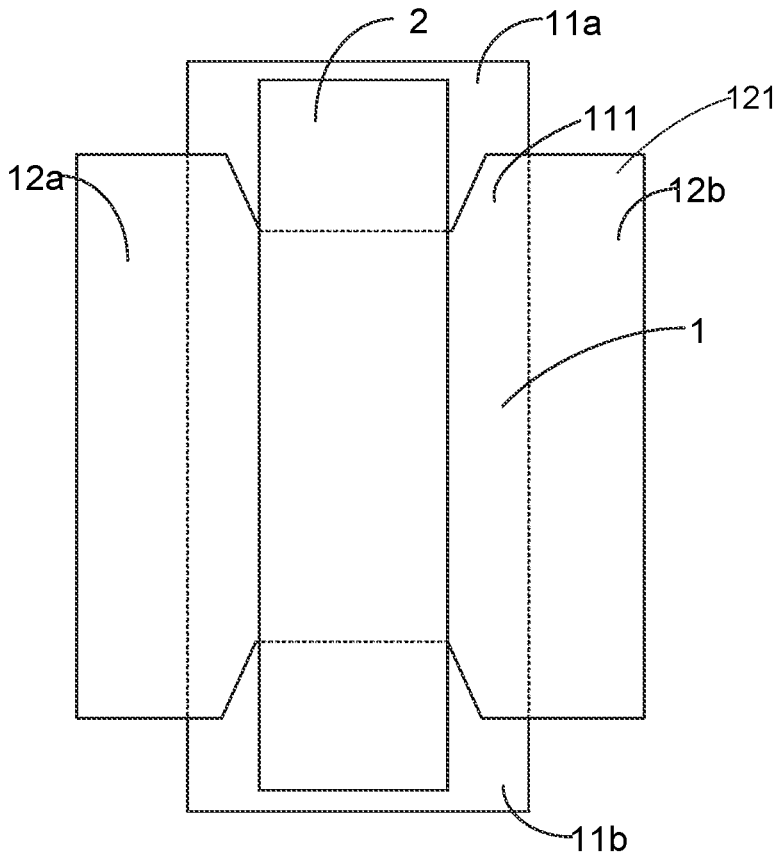
FIG. 8 is a schematic diagram illustrating a packaging apparatus according to some embodiments of the present disclosure.

In some embodiments, the first protruding plate 111 and the second protruding plate 121 may be combined in one packaging apparatus. For example, FIG. 8 is a schematic diagram illustrating an exemplary packaging apparatus according to some embodiments of the present disclosure. As shown in FIG. 8, based on the first protruding plate 111 of the packaging apparatus shown in FIG. 7A, the fourth side plate 12*b* may be protruded relative to the base plate 1 to form the second protruding plate 121. In some embodiments, the second protruding plate 121 and the first protruding plate 111 may be an integrated structure. In some embodiments, the second protruding plate 121, the first protruding plate 111, and the fourth side plate 12*b* may be an integrated structure. In some embodiments, the second protruding plate 121 may be independent of the first side plate 11*a* and/or the fourth side plate 12*b*. In other words, the second protruding plate 121 may be physically connected with the first side plate 11*a* and/or the fourth side plate 12*b*. A size of the second protruding plate 121 may match a size of the end of the fourth side plate 12*b* as shown in FIG. 8.

Figure 9:
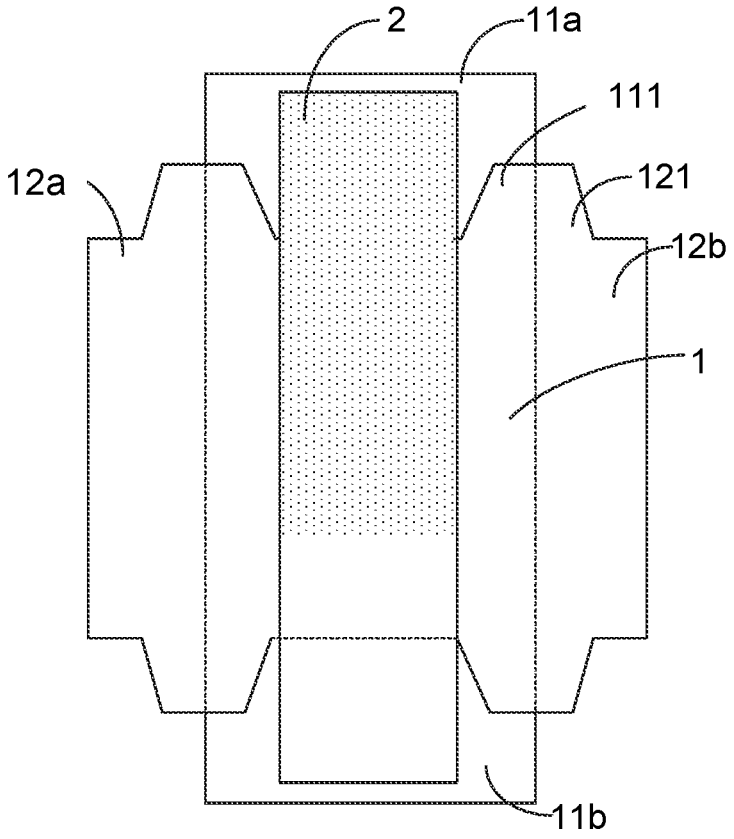
FIG. 9 is a schematic diagram illustrating a packaging apparatus according to some embodiments of the present disclosure.

In some embodiments, a step shape may be formed between the second protruding plate 121 and the fourth side plate 12*b* (or the third side plate 12*a*). For example, FIG. 9 is a schematic diagram illustrating an exemplary packaging apparatus according to some embodiments of the present disclosure. Different from the packaging apparatus as shown in FIG. 8, the step shape may be formed at end parts of the fourth side plate 12*b*. For example, the step shape may be formed between the second protruding plate 121 and the fourth side plate 12*b* as shown in FIG. 9.

Figure 10:
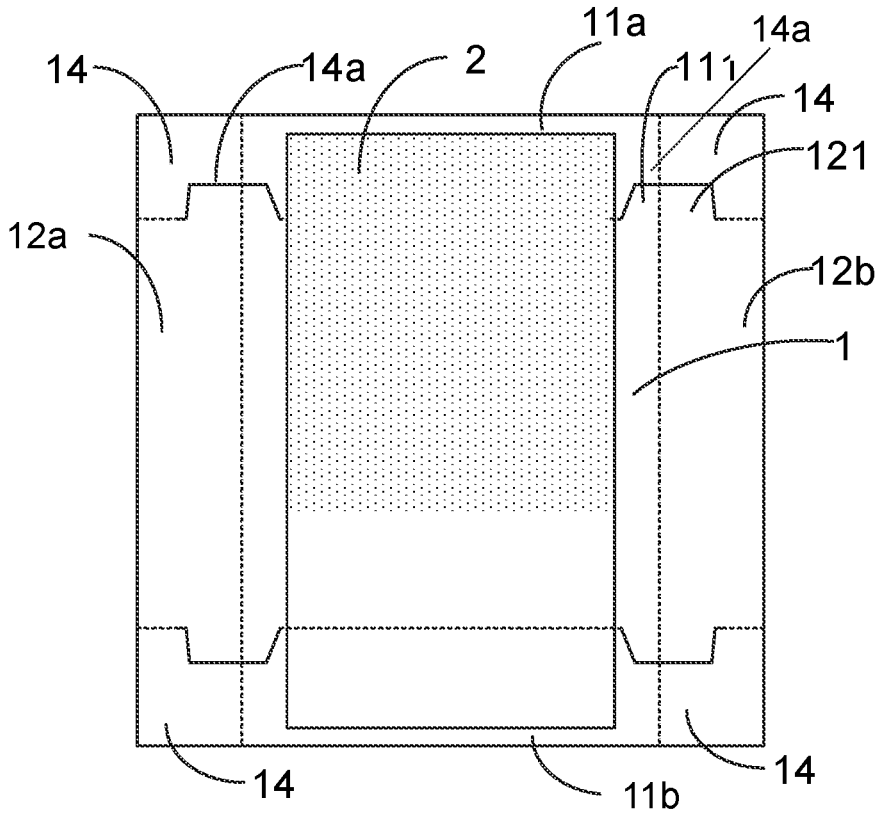
FIG. 10 is a schematic diagram illustrating a packaging apparatus according to some embodiments of the present disclosure.

In some embodiments, one or more corner plates 14 may be disposed between each two adjacent side plates of the first side plate 11*a*, the third side plate 12*a*, the second side plate 11*b*, and the fourth side plate 12*b*. For example, FIG. 10 is a schematic diagram illustrating an exemplary packaging apparatus according to some embodiments of the present disclosure. Different from the packaging apparatus as shown in FIG. 9, corner plates 14 may be disposed between two adjacent side plates of the first side plate 11*a*, the third side plate 12*a*, the second side plate 11*b*, and the fourth side plate 12*b*. When the first side plate 11*a*, the third side plate 12*a*, the second side plate 11*b*, and/or the fourth side plate 12*b* are folded, the corner plate(s) 14 may be folded. For example, the corner plates 14 disposed between two adjacent side plates of the first side plate 11*a*, the third side plate 12*a*, the second side plate 11*b*, and the fourth side plate 12*b* may be firstly folded together the folding of the first side plate 11*a* and the second side plate 11*b* toward the back side of the base plate 1. Then the corner plates 14 may be folded again together the folding of the third side plate 12*a* and the fourth side plate 12*b* toward the front side of the base plate 1. Based on the packaging apparatus as shown in FIG. 9, the corner plate(s) 14 may be disposed between each two adjacent side plates of the first side plate 11*a*, the third side plate 12*a*, the second side plate 11*b*, and/or the fourth side plate 12*b*. In some embodiments, the corner plate(s) 14, the base plate 1, the four side plates, the first protruding plate 111, and the second protruding plate 121 may be an integrated structure. A cutting line 14*a* may be set on the first side plate 11*a* and the fourth side plate 12*b*. The first side plate 11*a* and the fourth side plate 12*b* may be cut along the cutting line 14*a* to form the first protruding plate 111, and the second protruding plate 121 and the cutting line 14*a* may conform a contour edge of the first protruding plate 111 and the second protruding plate 121.

Figure 11A:
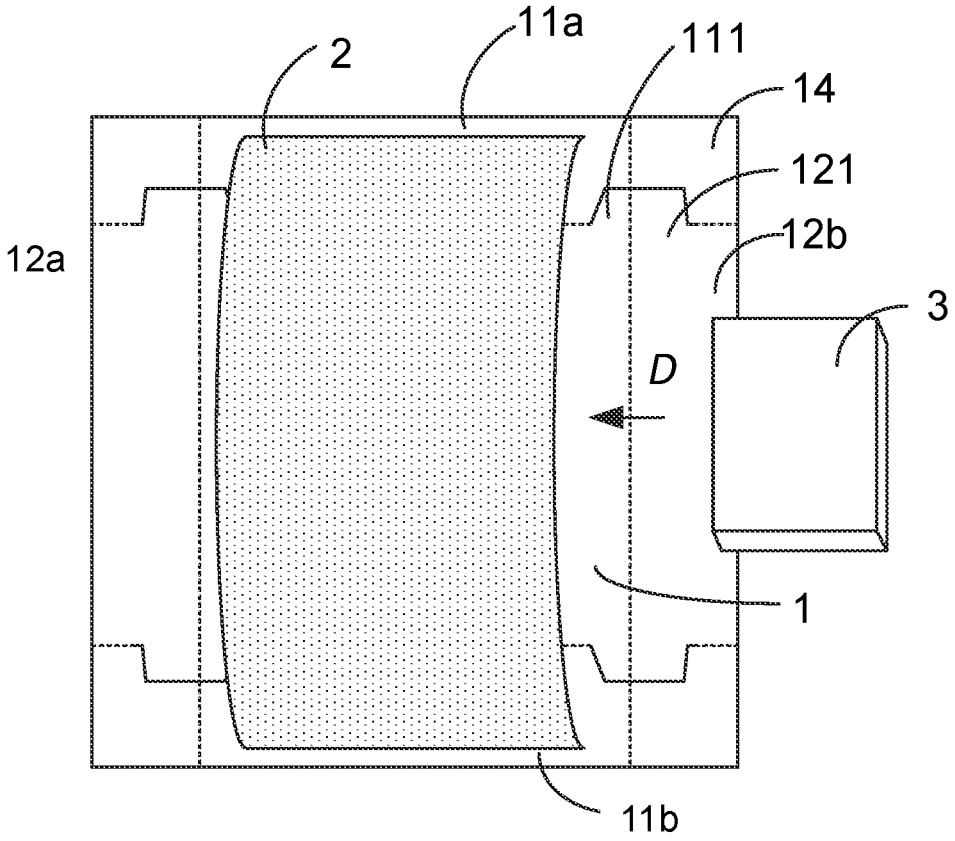
FIGS. 11A-11D are schematic diagrams illustrating a packaging process using a packaging apparatus according to some embodiments of the present disclosure.
Figure 11B:
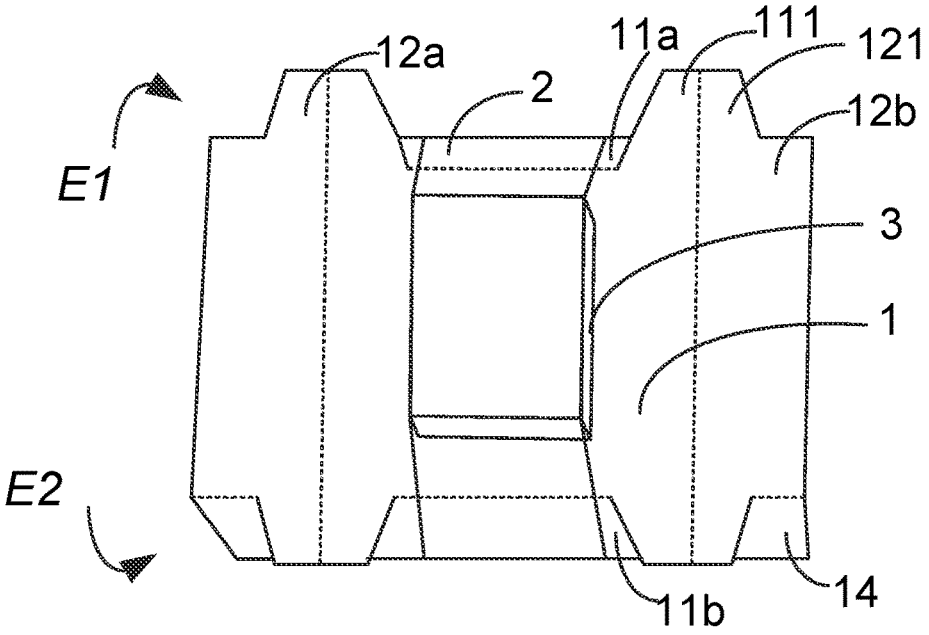
Figure 11C:
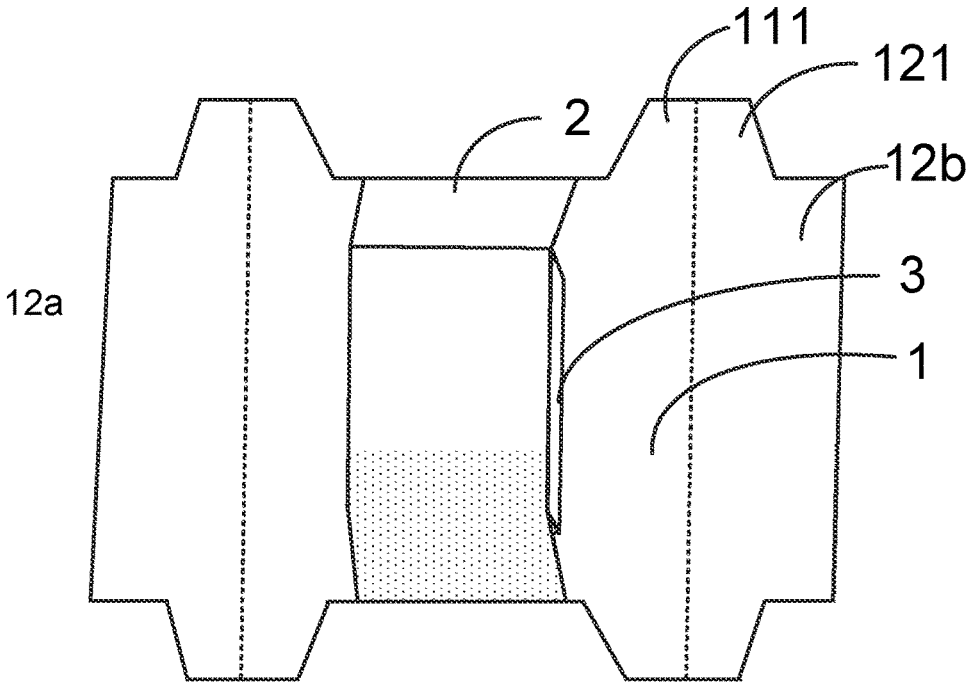
Figure 11D:
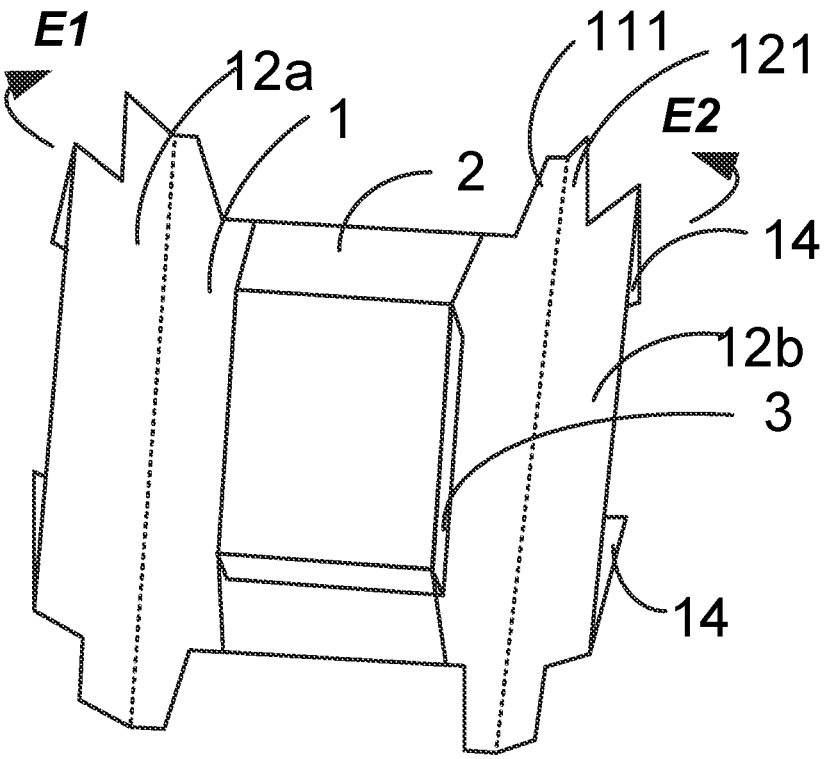

FIGS. 11A-11D are schematic diagrams illustrating a process for packaging a subject using a package apparatus according to some embodiments of the present disclosure. Taken a packaging apparatus shown in FIG. 10 as an example, a process of packaging a subject 3 may be described referring to FIGS. 11A-11D. The subject 3 may be placed in a space between the elastic sheet 2 and the base plate 1 as indicated by an arrow D in FIG. 11A. The first side plate 11*a* and the second side plate 11*b* may be folded toward the back side of the base plate 1 as indicated by arrows E1 and E2 as shown in FIG. 11B. In some embodiments, the first side plate 11*a* and the second side plate 11*b* may contact the back side of the base plate 1 as shown in FIG. 11C. The elastic sheet 2, two ends of which may be connected with the first side plate 11*a* and the second side plate 11*b*, may be stretched in the process of folding the first side plate 11*a* and the second side plate 11*b*. The elastic potential energy of the stretched elastic sheet 2 may press the subject 3 to the base plate 1 and limit a position of the subject 3. The elastic sheet 2 and the base plate 1 may cooperatively perform a fastening function on the subject 3. As shown in FIG. 11C, due to the existence of the first protruding plate 111 and the second protruding plate 121, when the first side plate 11*a* and the third side plate 12*a* are folded, the elastic sheet 2 may be stretched. The elastic sheet 2 may not cover the first protruding plate 111 and the second protruding plat 121. The subject 3 may be placed between the elastic sheet 2 and the base plate 1 at the center region of the base plate 1. The third side plate 12*a* and the fourth side plate 12*b* may be folded toward the front side of the base plate 1. The second protruding plate 121 may be folded along with the fourth side plate 12*b*. In some embodiments, the first protruding plate 111 and the folded second protruding plate 121 may be stacked to form a two-layer structure, which may improve the strength of the first protruding plate 111. In some embodiments, the folded third side plate 12*a* and the folded fourth side plate 12*b* may be perpendicular to the base plate 1. As shown in FIG. 11D, the folded third side plate 12*a* and/or the folded fourth side plate 12*b* may form a space and protect the subject 3 disposed on the base plate 1. The packaging apparatus shown in FIG. 11D may be placed in a packaging carton for transmitting or testing, and the multiple protruding plates (e.g., the first protruding plate 111 and the second protruding plate 121), the third side plate 12*a*, and the fourth side plate 12*b* may contact the packaging carton (e.g., the side walls of the packaging carton), such that the subject 3 may not contact the packaging carton during transportation or testing of the subject 3, thereby improving the protection of the packaging apparatus for the subject 3. In addition, the material cost and the labor cost of the packaging process of the packaging apparatus may be decreased. The packaging apparatus as described elsewhere in the present disclosure may have a simple structure, relatively low cost, etc., and may be applied for many different types of products in various packaging occasions, thereby having a development prospect.

According to some embodiments mentioned above, a packaging apparatus as described elsewhere in the present disclosure (e.g., FIGS. 1-2, 3A-3D, 4A-4B, and 6, and the descriptions thereof) may provide a cushioning function for a bottom portion of a subject to be packaged. According to some embodiments of the present disclosure, a packaging apparatus as described elsewhere in the present disclosure (e.g., FIGS. 7A-7D, and 8-10, and the descriptions thereof) may provide a cushioning function for a side portion of a subject to be packaged. In some embodiments, a packaging apparatus as described elsewhere in the present disclosure (e.g., FIGS. 12-18, and the descriptions thereof) may provide a cushioning function for a top portion of a subject to be packaged.

In some embodiments, one or more corrugated boards may be disposed on two sides of a packaging apparatus to support a top portion of the packaging apparatus. No physical support is disposed between a top surface of the packaging apparatus and the product. For a packaging apparatus with a large top surface area, the packaging apparatus may be squeezed or impacted during a movement or storage of the packaging apparatus when the packaging apparatus is stacked, which may cause depression or damage on the top surface of the packaging apparatus, thereby damaging the product, or bringing a safety risk. Therefore, some embodiments of the present disclosure provide a packaging apparatus that may be used to provide support and/or protection for the top surface of the product during packaging the product to protect the product more comprehensively. According to some embodiments of the present disclosure, a packaging apparatus is provided. The packaging apparatus may realize the protection or support for the top surface of the packaging apparatus or the product, thereby providing relatively comprehensive protection for the product.

In some embodiments, the packaging apparatus may include a first supporting plate, a second supporting plate, and a protection plate, which may be used to protect the top of the product. More descriptions for the packaging apparatus including the first supporting plate, the second supporting plate, and the protection plate may be found in FIGS. 12-27B.

Figure 12:
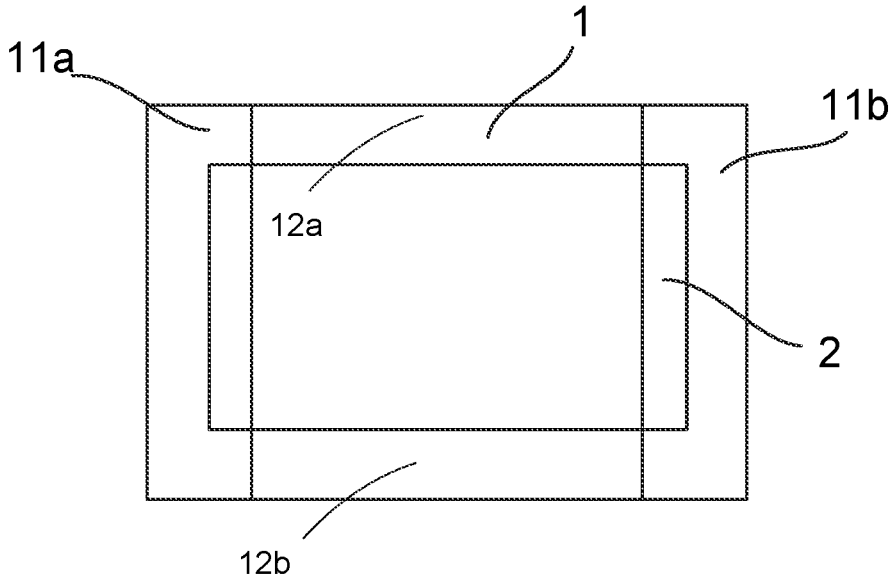
FIG. 12 is a schematic diagram illustrating a lining structure of a packaging apparatus according to some embodiments of the present disclosure.

For example, FIGS. 12-16 are schematic diagram illustrating exemplary packaging apparatuses according to some embodiments of the present disclosure. The packaging apparatus may be as described elsewhere in the present disclosure (e.g., FIGS. 1 and 2, and the descriptions thereof). For example, as shown in FIG. 12, the packaging apparatus may include a main body and an elastic sheet 2. The main body may include a base plate 1. The base plate 1 may include a first side edge, a second side edge, a third side edge, and a fourth side edge. The first side edge may be relative to the second side edge, and the third side edge may be relative to the fourth side edge. In some embodiments, the first side edge may be parallel with the second side edge, and the third side edge may be parallel with the fourth side edge.

In some embodiments, the main body may include a first side plate 11*a* and a second side plate 11*b* disposed beside the first side edge and the second side edge of the base plate 1, respectively. In some embodiments, the first side plate 11*a* and the second side plate 11*b* may be an integrated structure.

In some embodiments, the main body may include a third side plate 12*a* and a fourth side plate 12*b* disposed beside the third side edge and the fourth side edge of the base plate 1, respectively. In some embodiments, the third side plate 12*a* and the fourth side plate 12*b* may be an integrated structure.

In some embodiments, the base plate 1, the first side plate 11*a*, the second side plate 11*b*, the third side plate 12*a*, and the fourth side plate 12*b* may be formed integrally. In some embodiments, the first side plate 11*a* and the second side plate 11*b* may be physically connected with the base plate 1, such as by an adhesive, rivets, etc. The third side plate 12*a* and the fourth side plate 12*b* may be physically connected with the base plate 1, such as by an adhesive, rivets, etc.

Figure 13:
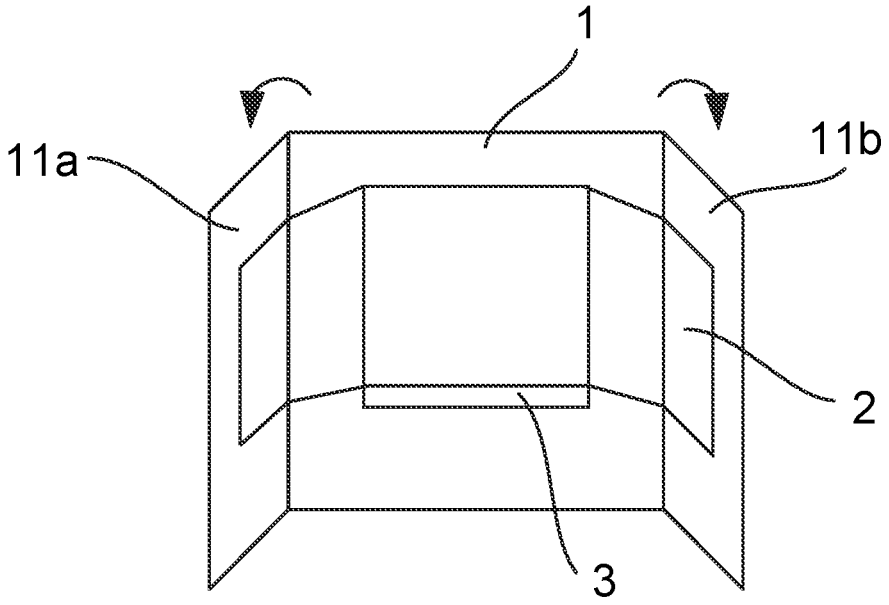
FIG. 13 is a schematic diagram illustrating a lining structure of a packaging apparatus according to some embodiments of the present disclosure.

The elastic sheet 2 may be placed above the base plate 1. Two ends of the elastic sheet 2 may be connected with the first side plate 11*a* and the second side plate 11*b*, respectively. A space may be formed between the elastic sheet 2 and the base plate 1. The space may be used to accommodate a subject (e.g., a product) to be packaged. As shown in FIG. 13, when a subject 3 (e.g., a product) is packaged, the subject 3 may be placed in the space. The first side plate 11*a* and the second side plate 11*b* may be folded relative to the base plate 1 toward the back side of the base plate 1, and the elastic sheet 2 may be stretched to press the subject 3 to the base plate 1 and fasten the subject 3.

Figure 14:
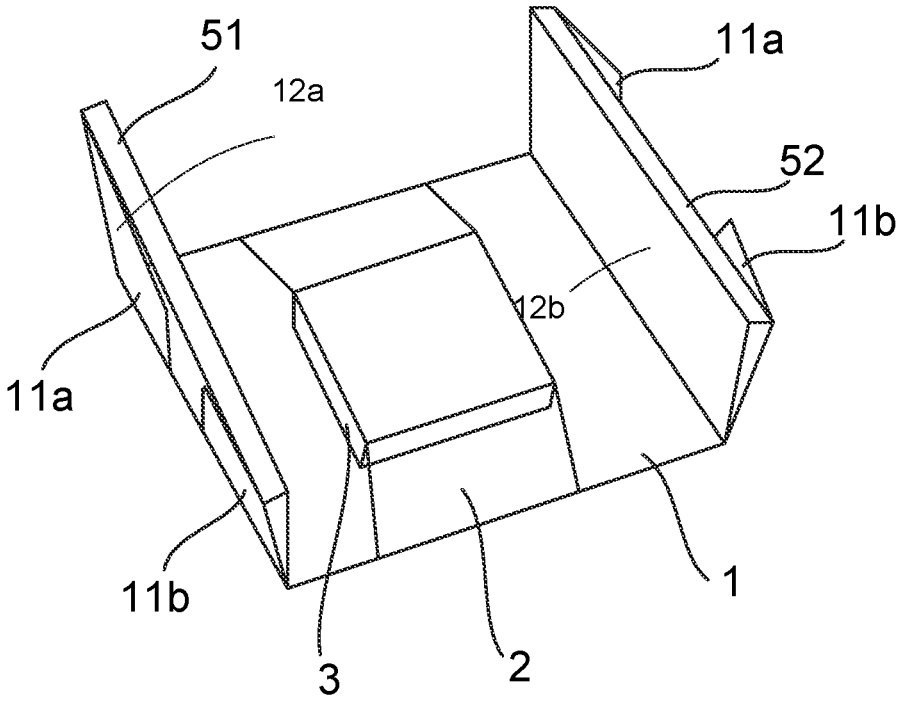
FIG. 14 is a schematic diagram illustrating a lining structure and a supporting structure of a packaging apparatus according to some embodiments of the present disclosure.

As shown in FIG. 14, after the first side plate 11*a* and the second side plate 11*b* are folded relative to the base plate 1 toward the back side of the base plate 1, the third side plate 12*b* and the fourth side plate 12*b* may be folded toward the front side of the base plate 1.

In some embodiments, as shown in FIG. 14, the packaging apparatus may include a first supporting plate, a second supporting plate, and a protection plate (not shown). In some embodiments, the packaging apparatus may merely include the protection plate. The first supporting plate may be connected with the third side plate 12*a*, and the second supporting plate may be connected with the fourth side plate 12*b*. In some embodiments, the first supporting plate and the third side plate 12*a* may be stacked together to form a two-layer structure and the fourth side plate 12*b* and the second supporting plate may be stacked together to form a two-layer structure, thereby improving strength of the third side plate 12*a* and the fourth side plate 12*b*. A protection space may be formed between the first supporting plate and the second supporting plate after the first supporting plate and the second supporting plate are folded.

In some embodiments, the first supporting plate and the third side plate 12*a* may form a first supporting structure 51, and the second supporting plate and the fourth side plate 12*b* may form a second supporting structure 52.

In some embodiments, the packaging apparatus 1200 may include a protection plate that may be disposed within the protection space formed by the first supporting plate 51 and the second supporting plate 52.

Figure 15:
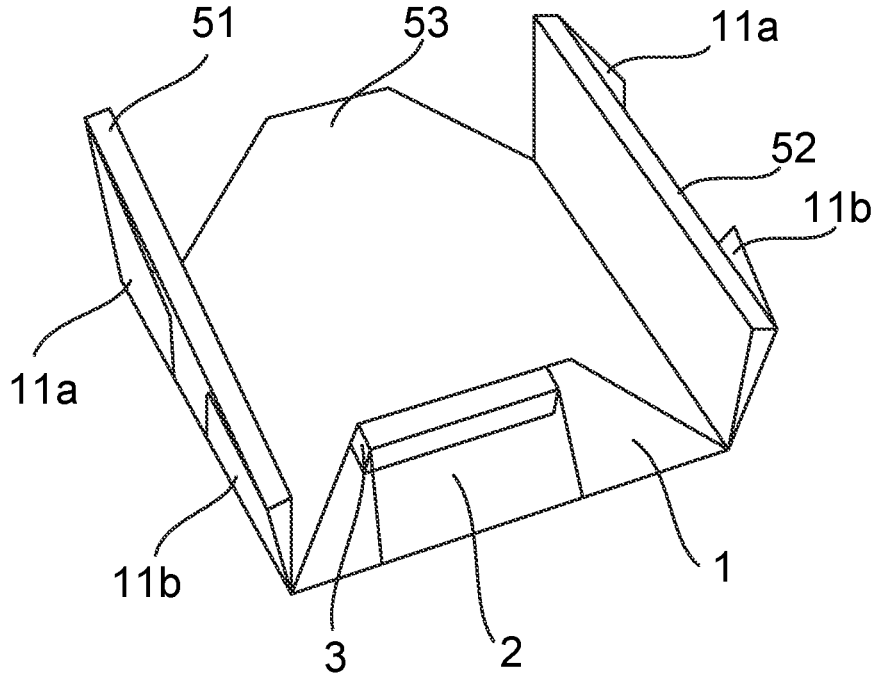
FIG. 15 is a schematic diagram illustrating a packaging apparatus according to some embodiments of the present disclosure.
Figure 16:
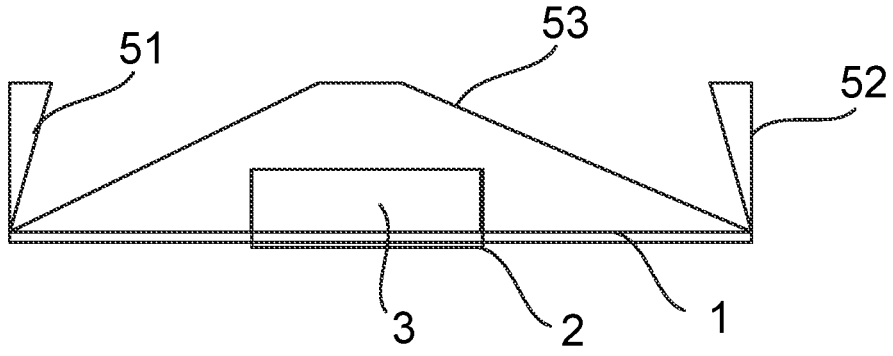
FIG. 16 is a schematic diagram illustrating a side structure of a packaging apparatus according to some embodiments of the present disclosure.

As shown in FIG. 15, a protection plate 53 may be disposed within the protection space formed by the first supporting structure 51 and the second supporting structure 52, and protect the subject 3 (e.g., a product) together with the first supporting structure 51 and the second supporting structure 52. FIG. 16 is a schematic diagram illustrating a side view of the packaging apparatus as shown in FIG. 15 according to some embodiments of the present disclosure. The protection provided by the first supporting structure 51, the second supporting structure 52, and the protection plate 53 for the product may refer to FIG. 16.

When the subject 3 is packaged using the package apparatus as shown in FIG. 16, the elastic sheet 2 may be stretched and used to immobilize the subject 3 above the base plate 1 when the first side plate 11*a* and the second side plate 11*b* are folded toward the back side of the base plate 1. The first supporting structure 51 and the second supporting structure 52 may form the protection space which may be used to protect the subject 3 together with the protection plate 53 disposed within the protection space. The package apparatus may protect the top portion of the subject 3 when the subject 3 is placed between the elastic sheet 2 and the base plate 1, thereby improving the impact resistance performance of the packaging apparatus, improving the compressive strength of the top surface of the packaging apparatus, preventing the top portion of a packaging carton wherein the packaging apparatus is located from being depressed due to stress, providing comprehensive protection for the subject 3, and improving the packaging safety of the subject 3. In addition, the subject 3 can be taken out from the packaging carton when the protection plate 53 is destroyed, such that the protection plate 53 may perform an anti-theft function.

Figure 17:
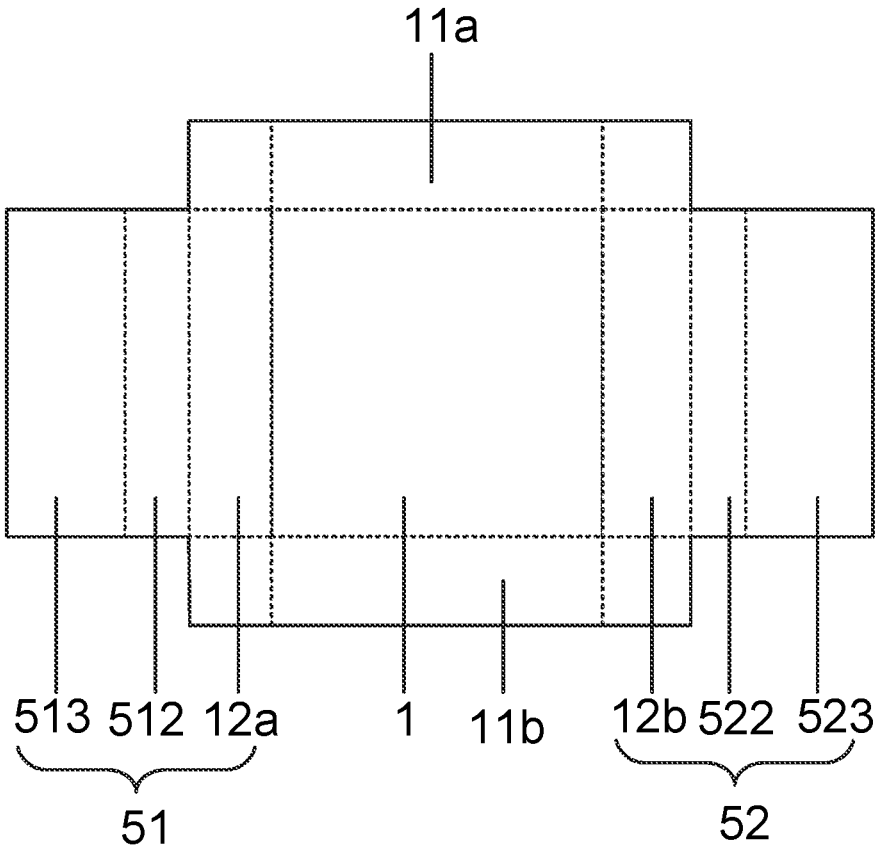
FIG. 17 is a schematic diagram illustrating a lining structure and a supporting structure of a packaging apparatus according to some embodiments of the present disclosure.

FIG. 17 is a schematic diagram illustrating an exemplary main body of a packaging apparatus according to some embodiments of the present disclosure. FIG. 17 shows an unfolded main body of the packaging apparatus. As shown in FIG. 17, the main body may include a base plate 1, a first side plate 11*a*, a second side plate 11*b*, a third side plate 12*a*, a fourth side plate 12*b*, a first top plate 512, a first foldback plate 513, a second top plate 522, and a second foldback plate 523. More descriptions of the first side plate 11*a*, the second side plate 11*b*, the third side plate 12*a*, and the fourth side plate 12*b* may be found elsewhere in the present disclosure.

As shown in FIG. 17, the third side plate 12*a*, the first top plate 512, and the first foldback plate 513 may be used to form the first supporting structure 51 as shown in FIGS. 15 and 16. And the fourth side plate 12*b*, the second top plate 522, and the second foldback plate 523 may be used to form the second supporting structure 52 as shown in FIGS. 15 and 16. The first top plate 512 may be connected with the third side plate 12*a*. The first foldback plate 513 may be connected with the first top plate 512. The second top plate 522 may be connected with the fourth side plate 12*b*. The second foldback plate 523 may be connected with the second top plate 522.

In some embodiments, the third side plate 12*a*, the first top plate 512, and the first foldback plate 513 may be folded to form the first supporting structure 51, and the fourth side plate 12*b*, the second top plate 522, and the second foldback plate 523 may be formed to form the second supporting structure 52. For example, the third side plate 12*a* may be folded toward the front side of the base plate 1 to be substantially perpendicular to the base plate 1 toward the front side of the base plate 1, and then the first top plate 512 may be folded toward the front side of the base plate 1 to be substantially parallel with the base plate 1 to form a top portion of the first supporting structure 51. The first foldback plate 513 may be folded toward the second side plate 11*b*. The folded first foldback plate 513 may be physically connected with the folded second side plate 12. The folded first foldback plate 513 and the folded second side plate 12 may form two side walls of the first supporting structure 51. The second supporting structure 52 may be formed as similar or same as the first supporting structure 51.

Figure 18:
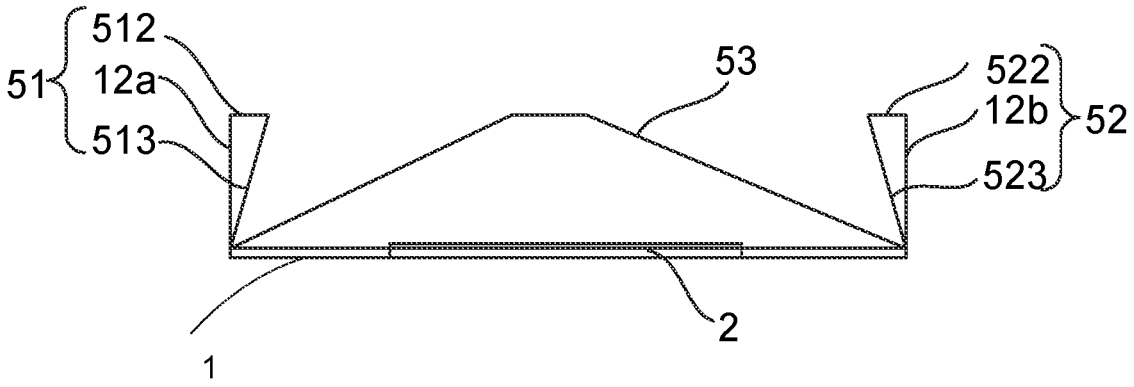
FIG. 18 is a schematic diagram illustrating a side view of a packaging apparatus according to some embodiments of the present disclosure.

FIG. 18 s a schematic diagram illustrating the folded main body of the packaging apparatus as described in FIG. 17 according to some embodiments of the present disclosure. As shown in FIG. 18, the third side plate 12*a*, the first top plate 512, and the first foldback plate 513 may form a first triangular supporting part 51 (i.e., the first supporting structure) on a side of the base plate 1. The fourth side plate 12*b*, the second top plate 522, and the second foldback plate 523 may form a second triangular supporting part 52 (i.e., the first supporting structure) on another side of the base plate 1. The first triangular supporting part 51 and the second triangular supporting part 52 may be disposed relative to each other, and form the protection space.

In some embodiments, the first triangular supporting part 51 may be the same as the second triangular supporting part 52, and the first top plate 512 and the second top plate 522 may be parallel to the base plate 1, respectively.

In some embodiments, the third side plate 12*a*, the first top plate 512, the first foldback plate 513, and the base plate 1 may be an integrated structure. The fourth side plate 12*b*, the second top plate 522, the second foldback plate 523, and the base plate 1 may be an integrated structure. The third side plate 12*a*, the first top plate 512, the first foldback plate 513, the base plate 1, the fourth side plate 12*b*, the second top plate 522, the second foldback plate 523 may be formed by a plate (e.g., a paper card or a sheet). The packaging apparatus may be generated by folding the plate, which may improve the design of the packaging apparatus, save the raw material, and optimize the production steps of the packaging apparatus.

The first triangular supporting part 51 and the second triangular supporting part 52 may form the protection space which may protect the top portion of the packaging apparatus and a subject to be packaged. The protection plate 53 disposed in the protection space may protect the subject together with the first triangular supporting part 51 and the second triangular supporting part 52. Specifically, a structure of the protection plate 53 may be various. One or more structures of the protection plate 53 may be described according to the following examples.

EXAMPLE 1

Figure 19:
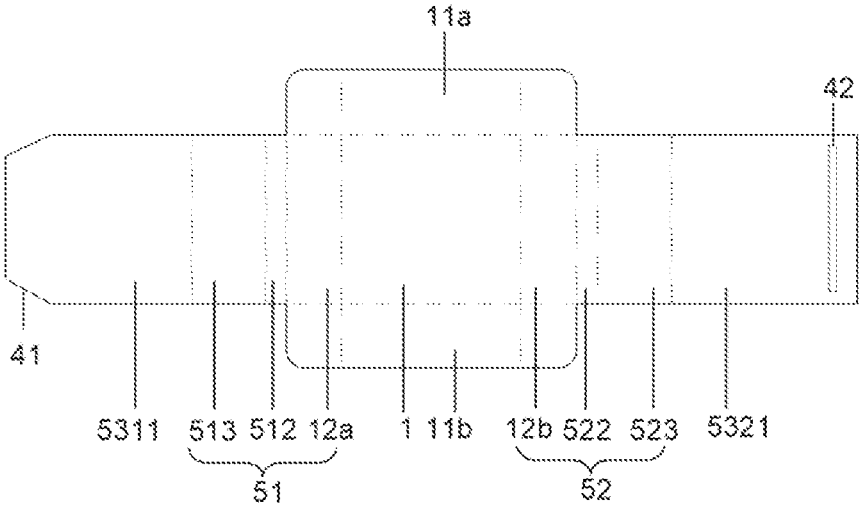
FIG. 19 is a schematic diagram illustrating a packaging apparatus according to some embodiments of the present disclosure.
Figure 20:
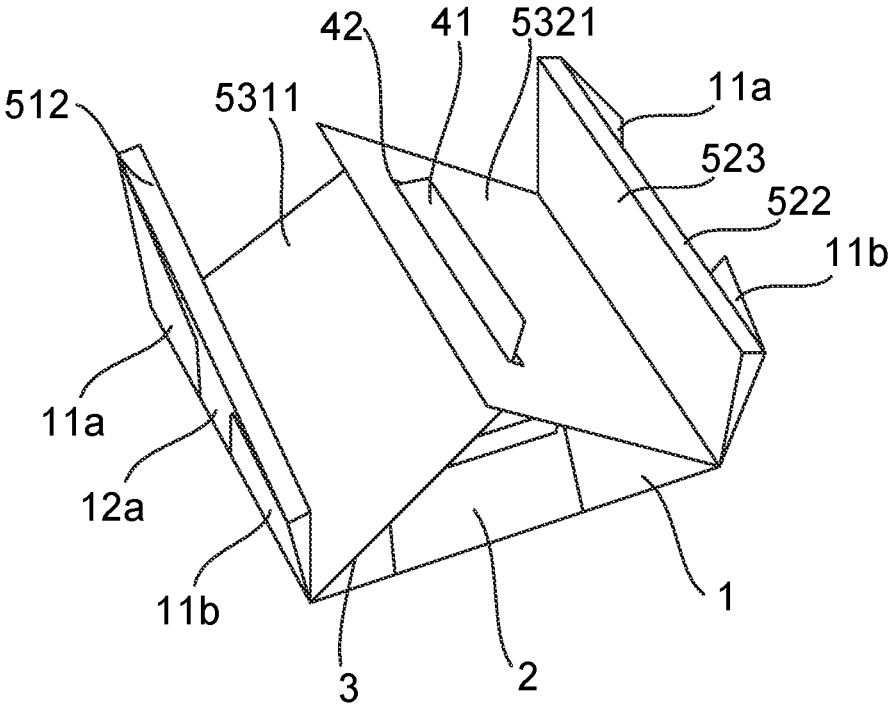
FIG. 20 is a schematic diagram illustrating a packaging apparatus according to some embodiments of the present disclosure.

FIGS. 19-20 are schematic diagrams illustrating an exemplary main body of a packaging apparatus according to some embodiments of the present disclosure. FIG. 19 shows an unfolded main body of the packaging apparatus. Based on the base plate 1 as described in FIG. 17, as shown in FIG. 19, the base plate 1 may further include a first connection plate 5311 connected with the first foldback plate 513 and a second connection plate 5321 connected with the second foldback plate 523. The first connection plate 5311 and the second connection plate 5321 may be used to form the protection plate 52 as described in FIG. 17. For example, as shown in FIG. 20, after the first triangular supporting part 51 and the second triangular supporting part 52 are folded as described in FIGS. 17-18, an end of the first connection plate 5311 may be physically connected with an end of the second connection plate 5321 to form the protection plate 53 as described in FIG. 17. As shown in FIG. 20, the first connection plate 5311 and the second connection plate 5321 may form an arched structure, thereby protecting a top portion of a subject to be packaged without affecting that the base plate 1 and elastic sheet 2 fasten or immobilize the subject 3.

In some embodiments, the first connection plate 5311 may include a connection ear plate 41, and the second connection plate 5321 may include a connection slot 42 which may be configured to snap with the connection ear plate 41. When a subject is packaged, the connection ear plate 41 may be inserted into the connection slot 42 to be fixed. In some embodiments, a shape of the connection ear plate 41 may include a trapezoid. A short side of the connection ear plate 41 may be inserted into the connection slot 42, and a relatively long side which is parallel to the short side may be connected with the first connection plate 5311, thereby improving a connection convenience of the connection ear plate 41. The connection ear plate 41 and the first connection plate 5311 may be formed integrally. In some embodiments, a shape of the connection slot 42 may be matched a shape of the connection ear plate 41. A length of the connection slot 42 may be less than a length of the relatively long side of the connection ear plate 41. The connection ear plate 41 may be inserted into the connection slot 42, and the connection slot 42 may limit a position of the connection ear plate 41. In some embodiments, the length of the connection slot 42 may be equal to the length of the relatively long side of the connection slot 42. A limiting part may be disposed on the first connection plate 5311, which may be configured to limit the position of the connection ear plate 41 after being inserted into the connection slot 42. For example, the first connection plate 5311 may include one or more protruding portions. The one or more protruding portions may be protruded along a direction parallel to the first side edge of the base plate 1 and configured to limit the limit the position of the connection ear plate 41 after being inserted into the connection slot 42.

In some embodiments, the shape of the connection ear plate 41 may include a regular shape, an irregular shape, or the like, which can be matched with the shape of the connection slot 42, which is not limited herein.

In some embodiments, a connection between the first connection plate 5311 and the second connection plate 5321 may include a snaping-fit connection, a Velcro connection, a bonding connection, a magnetic connection, or the like, or any combination thereof. For example, using the snaping-fit connection between the first connection plate 5311 and the second connection plate 5321, a snapping part may be disposed on one of the first connection plate 5311 and the second connection plate 5321, and a matching part may be disposed on the other one of the first connection plate 5311 and the second connection plate 5321. The snapping part and the matching part may be matched to perform the snaping-fit connection between the first connection plate 5311 and the second connection plate 5321. Using the velcro connection between the first connection plate 5311 and the second connection plate 5321, a first Velcro may be disposed on one of the first connection plate 5311, a second Velcro may be disposed on and the second connection plate 5321. The first Velcro and the second Velcro may be matched to perform the connection between the first connection plate 5311 and the second connection plate 5321. Using the bonding connection between the first connection plate 5311 and the second connection plate 5321, a bonding part with an adhesive may be disposed on one of the first connection plate 5311 and the second connection plate 5321, and the bonding part may be bonded to the other one of the first connection plate 5311 and the second connection plate 5321 to perform the connection therebetween. Using the magnetic connection between the first connection plate 5311 and the second connection plate 5321, a magnet may be disposed on one of the first connection plate 5311 and the second connection plate 5321, a substance which can be attracted by the magnet may be disposed on the other one of the first connection plate 5311 and the second connection plate 5321. The magnet and the substance may be attracted by each other to perform the connection between the first connection plate 5311 and the second connection plate 5321.

EXAMPLE 2

Figure 21:
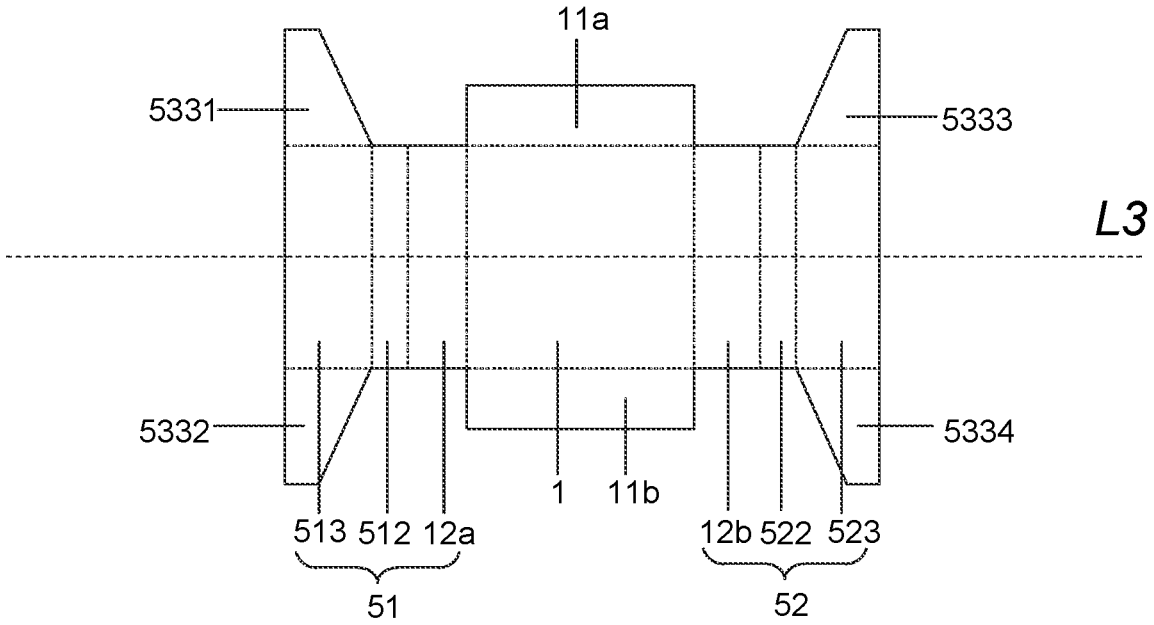
FIG. 21 is a schematic diagram illustrating a packaging apparatus according to some embodiments of the present disclosure.
Figure 22:
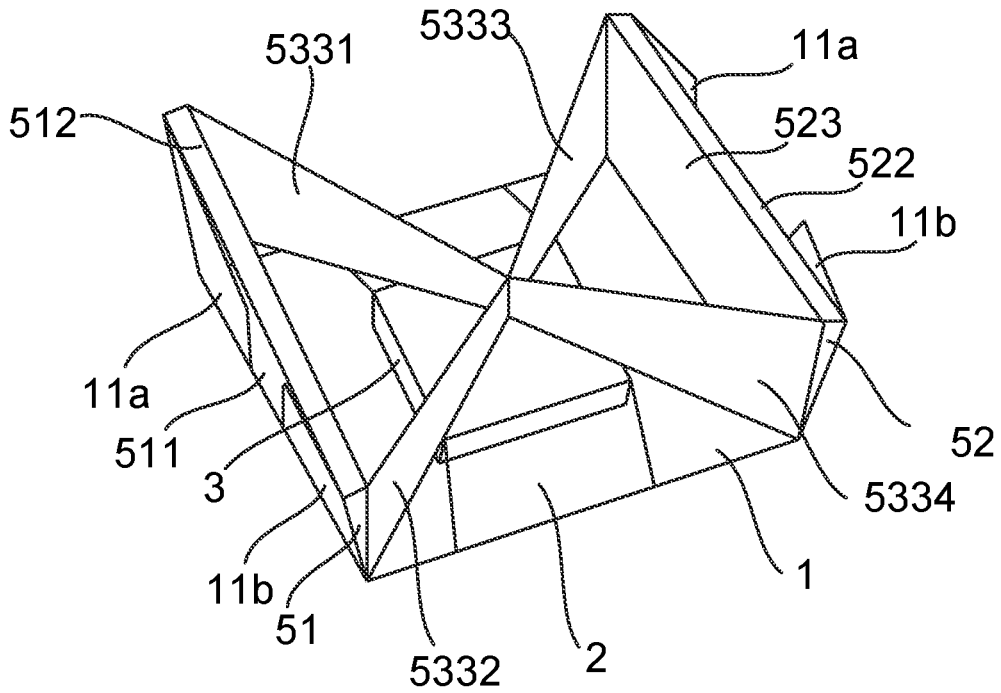
FIG. 22 is a schematic diagram illustrating a packaging apparatus according to some embodiments of the present disclosure.

FIGS. 21-22 are schematic diagrams illustrating an exemplary main body of a packaging apparatus according to some embodiments of the present disclosure. FIG. 21 shows an unfolded main body of the packaging apparatus. Based on the base plate as described in FIG. 17, as shown in FIG. 21, the base plate may further include a first protection ear plate 5331, a second protection ear plate 5332, a third protection ear plate 5333, and a fourth protection ear plate 5334. The first protection ear plate 5331 and the second protection ear plate 5332 may be disposed along two sides of the first foldback plate 513, respectively. The third protection ear plate 5333 and the fourth protection ear plate 5334 may be disposed along two sides of the second foldback plate 523, respectively. The first protection ear plate 5331 may be symmetric with the second protection ear plate 5332 relative to a center line (denoted by line L3) of the base plate 1, and the third protection ear plate 5333 may be symmetric with the fourth protection ear plate 5334 relative to the center line of the base plate.

The first protection ear plate 5331, the second protection ear plate 5332, the third protection ear plate 5333, and the fourth protection ear plate 5334 may be used to form a protection structure. For example, FIG. 22 shows a folded base plate as described in FIG. 21. As shown in FIG. 22, when a subject (e.g., a product) is packaged, after the first triangular supporting part 51 and the second triangular supporting part 52 are folded as described in FIGS. 17-18, the first protection ear plate 5331 and the second protection ear plate 5332 may be folded toward the inner side of the first triangular supporting part 51 that faces the subject to be packaged (i.e., toward the center region of the protection space formed by the first triangular supporting part 51 and the second triangular supporting part 52), and the third protection ear plate 5333 and the fourth protection ear plate 5334 may be folded toward the inner side of the second triangular supporting part 52 that faces the subject to be packaged (i.e., toward the center region of the protection space formed by the first triangular supporting part 51 and the second triangular supporting part 52). In some embodiments, an end of the first protection ear plate 5331 away from the first foldback plate 513 may be physically connected with an end of the fourth protection ear plate 5334 away from the second foldback plate 523. An end of the second protection ear plate 5332 away from the first foldback plate 513 may be physically connected with an end of the third protection ear plate 5333 away from the second foldback plate 523. In some embodiments, an end of the first protection ear plate 5331 away from the first foldback plate 513 may be physically connected with an end of the second protection ear plate 5332 away from the first foldback plate 513. An end of the third protection ear plate 5333 away from the second foldback plate 523 may be physically connected with an end of the fourth protection ear plate 5334 away from the second foldback plate 523. In some embodiments, an end of the first protection ear plate 5331 away from the first foldback plate 513 may be physically connected with an end of the third protection ear plate 5332 away from the second foldback plate 523. An end of the second protection ear plate 5332 away from the second foldback plate 523 may be physically connected with an end of the fourth protection ear plate 5334 away from the second foldback plate 523. In some embodiments, a connection between the first protection ear plate 5331, the second protection ear plate 5332, the third protection ear plate 5333, and/or the fourth protection ear plate 5334 may include but is not limited to a snaping connection, a Velcro connection, a bonding connection, a magnetic connection, or the like, or a combination thereof. More descriptions regarding the implementation of the connection may be found elsewhere in the present disclosure, which is not limited herein.

In some embodiments, a length of each of the first protection ear plate 5331, the second protection ear plate 5332, the third protection ear plate 5333, and the fourth protection ear plate 5334 may be the same or may be different. A length of a protection ear plate refers to a length of the protection ear plate in a direction that is perpendicular to the center line L3 of the base plate 1 as shown in FIG. 21. In some embodiments, the length of each of four protection ear plates (i.e., the first protection ear plate 5331, the second protection ear plate 5332, the third protection ear plate 5333, and the fourth protection ear plate 5334) may be related to a size (e.g., the length) of the first side edge, the second side edge, the third side edge, and the fourth side edge of the base plate 1. When a shape of a base plate 1 is a square or a rectangle, the length of each of the four protection ear plates may be greater than or equal to (or substantially equal to) half of a diagonal of the base plate 1, and the four protection ear plates may be intersected at a point (e.g., the center point) of the square or the rectangle. In some embodiments, the length of each of the four protection ear plates may be less than half of the diagonal of the base plate 1. Merely by way of example, the first protection ear plate 5331 may be connected with the second protection ear plate 5332, and the third protection ear plate 5333 may be connected with the fourth protection ear plate 5334. In some embodiments, lengths of two of the four protection ear plates may be less than half of the diagonal of the base plate 1. Lengths of the other two of the four protection ear plates may be greater than or equal to half of the diagonal of the base plate 1. Merely by way of example, the length of each of the first protection ear plate 5331 and the second protection ear plate 5332 may be less than half of the diagonal of the base plate 1. The length of each of the third protection ear plate 5333 and the fourth protection ear plate 5334 may be greater than or equal to half of the diagonal of the base plate 1. In some embodiments, a ratio between the length of each of the four protection ear plates and half of the diagonal of the base plate 1 may be 0.3~1.5, 0.4~1.2, 0.5~1, or 0.6~0.9. In some embodiments, the length of at least one of the four protection ear plates may be less than half of the diagonal of the base plate 1, and corresponding protection ear plates along the diagonal of the body portion may be not connected at the center point of the base plate 1. However, the corresponding protection ear plates can protect the product, which is included in the scope of the present disclosure.

It should be noted that the connection between the first protection ear plate 5331, the second protection ear plate 5332, the third protection ear plate 5333, and/or the fourth protection ear plate 5334 may include various connection types. For example, the first protection ear plate 5331 and the second protection ear plate 5332 may be connected or intersected at a first point, the third protection ear plate 5333 and the fourth protection ear plate 5334 may be connected or intersected at a second point, and the first point and the second point may be physically connected, for example, via a plate. As another example, the first protection ear plate 5331 may be connected or intersected with the fourth protection ear plate 5334, and the second protection ear plate 5332 may be connected or intersected with the first protection ear plate 5331 or the fourth protection ear plate 5334. As a further example, the second protection ear plate 5332 may be connected or intersected with the third protection ear plate 5333, and the first protection ear plate 5331 may be connected or intersected with the second protection ear plate 5332 or the third protection ear plate 5333. The fourth protection ear plate 5334 may be connected or intersected with the second protection ear plate 5332 or the third protection ear plate 5333.

EXAMPLE 3

In some embodiments, the protection plate as described elsewhere in the present disclosure may include a first cross plate 534 and a second cross plate 535. The first cross plate 534 may be intersected and matched the second cross plate 535. Specifically, the first cross plate 534 may include a first clamping part, and the second cross plate 535 may include a second clamping part. The first clamping part may be engaged with the second clamping part when the first cross plate 534 is intersected and matched the second cross plate 535. A type of the first clamping part and/or the second clamping part may include a slot type, a cutting line type, or the like, or any combination thereof.

Figure 23:
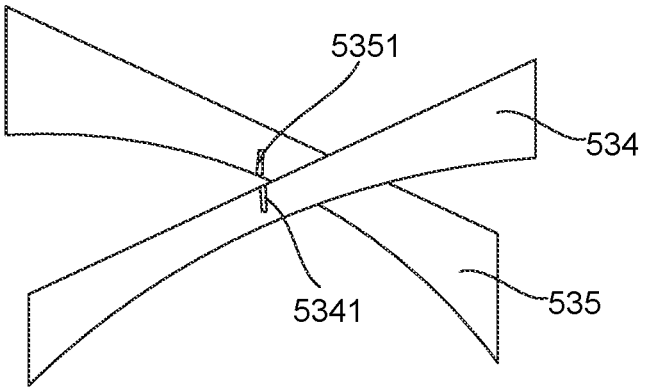
FIG. 23 is a schematic diagram illustrating a protection plate of a packaging apparatus according to some embodiments of the present disclosure.
Figure 24:
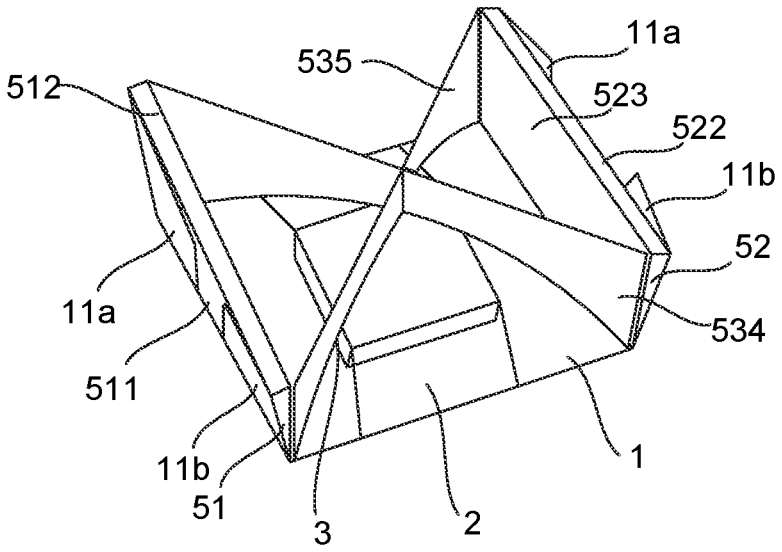
FIG. 24 a schematic diagram illustrating a packaging apparatus according to some embodiments of the present disclosure.

For example, FIG. 23 is a schematic diagram illustrating an exemplary protection plate of a packaging apparatus according to some embodiments of the present disclosure. As shown in FIG. 23, the protection plate 2300 may include the first cross plate 534 and the second cross plate 535, which may be perpendicular to a base plate of a packaging apparatus when a subject is packaged using the packaging apparatus. Based on the base plate 1 as described in FIG. 17, as shown in FIG. 24, after the first triangular supporting part 51 and the second triangular supporting part 52 are folded as described in FIG. 17, the first cross plate 534 may be intersected and matched the second cross plate 535 to form the protection plate.

Specifically, a first slot 5341 may be set on a side of the first cross plate 534 away from the base plate 1, and a second slot 5351 may be formed on a side of the second cross plate 535 facing the base plate 1. When the first cross plate 534 and the second cross plate 535 are mated, the second cross plate 535 may be inserted into the first slot 5341, and the second slot 5351 may be engaged with the first slot 5341. A length of the first slot 5341 may be the same as or similar to a length of the second slot 5351, and the first slot 5341 and the second slot 5351 may be perpendicular to the base plate 1. In some embodiments, the type of at least one of the first slot 5341 and the second slot 5351 may include a cutting line type, and the first slot 5341 and the second slot 5351 may be engaged by cutting marks of cutting lines thereof.

FIGS. 25A-25B, 26A-26B, and 27A-27B are schematic diagrams illustrating an exemplary first cross plate and a second cross plate of a protection plate of a packaging apparatus according to some embodiments of the present disclosure. Based on the packaging apparatus as shown in FIG. 24, in order to form a space between the elastic sheet 2 and the base plate 1 for accommodating the subject 3, a first notch 5342 may be formed on a side of the first cross plate 534 facing the base plate, and a second notch 5352 may be disposed on a side of the second cross plate 535 facing the base plate. The first notch 5342 and the second notch 5352 may form an arched space for accommodating the subject 3.

Figure 25A:
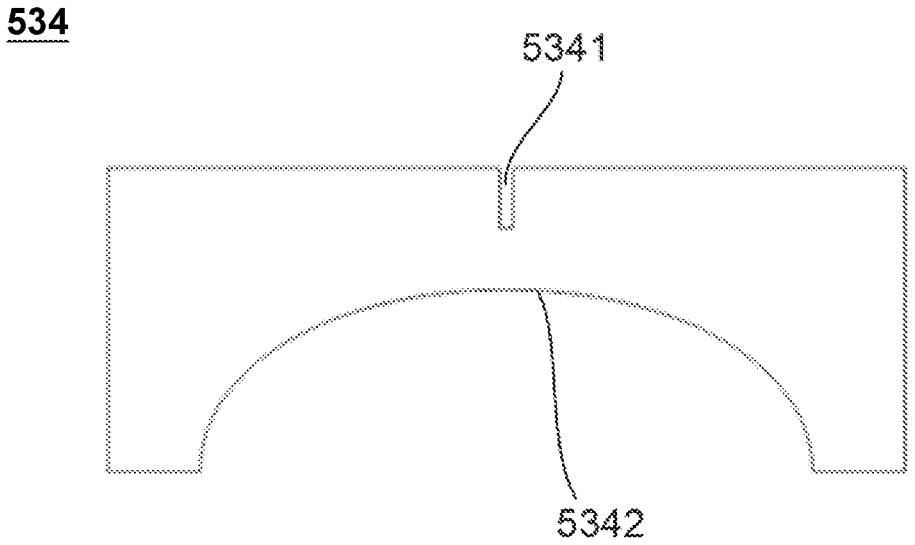
FIG. 25A and FIG. 25B are schematic diagrams illustrating a protection plate of a packaging apparatus according to some embodiments of the present disclosure.
Figure 25B:
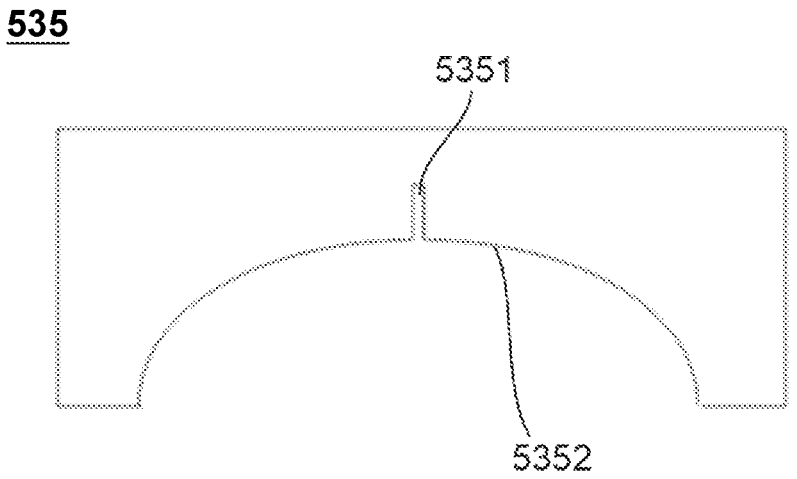
Figure 26A:
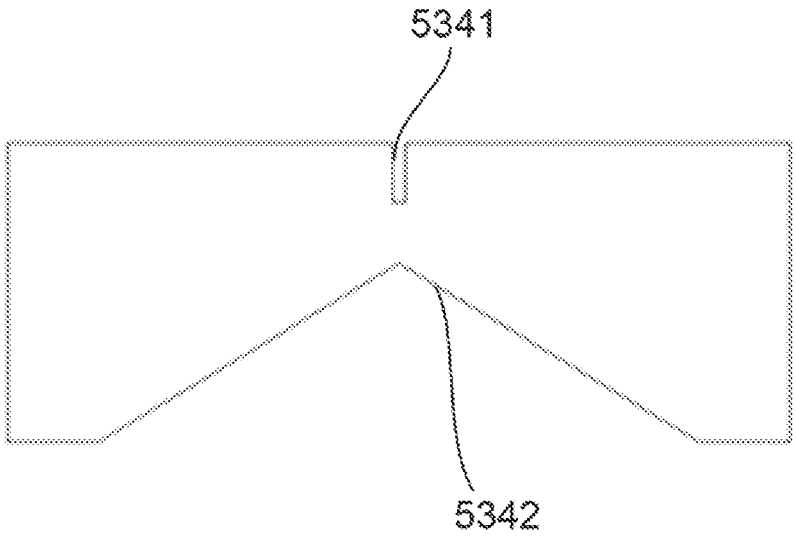
FIG. 26A and FIG. 26B are schematic diagrams illustrating a protection plate of a packaging apparatus according to some embodiments of the present disclosure.
Figure 26B:
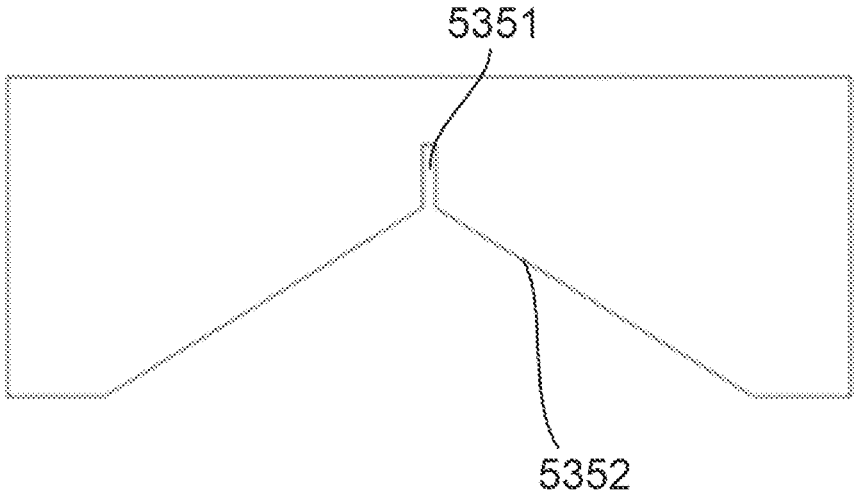
Figure 27A:
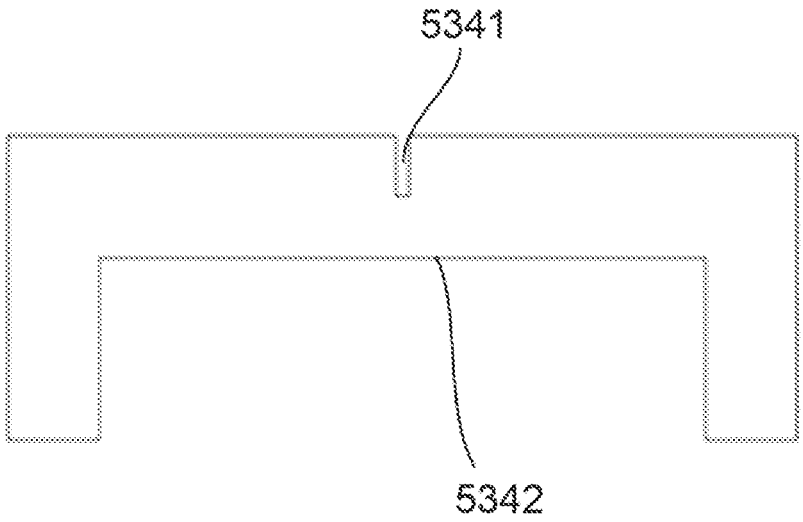
FIG. 27A and FIG. 27B are schematic diagrams illustrating a protection plate of a packaging apparatus according to some embodiments of the present disclosure.
Figure 27B:
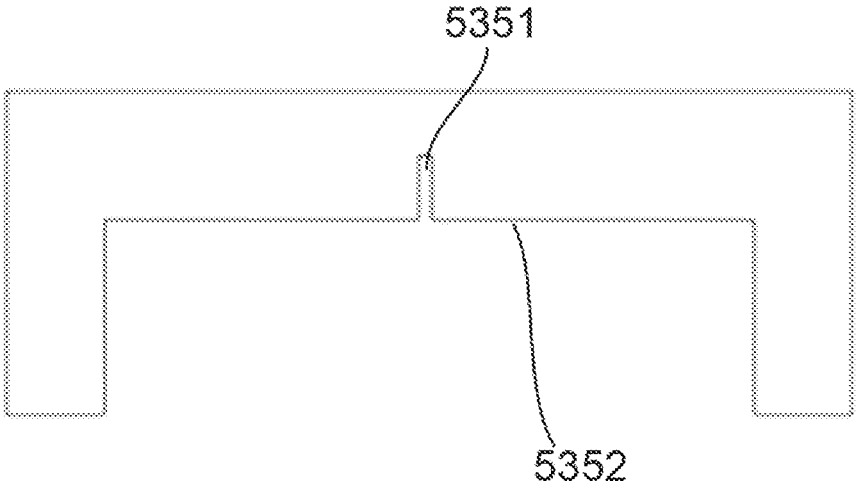

A type of at least one of the first cross plate 534 and the second cross plate 535 may be various, which may form the arched space for accommodating the subject 3 to meet the packaging requirement. As shown in FIG. 25A, the type of the first notch 5342 on the first cross plate 534 is curved, and correspondingly, the type of the second notch 5352 on the second cross plate 535 shown in FIG. 25B is curved. As shown in FIG. 26A, the type of the first notch 5342 on the first cross plate 534 is triangular, and correspondingly, the type of the second notch g 5352 on the second cross plate 535 shown in FIG. 26B is also triangular. As shown in FIG. 27A, the type of the first notch 5342 on the first cross plate 534 is rectangular, and correspondingly, the type of the second notch 5352 on the second cross plate 535 shown in FIG. 27B is also rectangular.

In some embodiments, the protection plate 53 may be independent of the first supporting structure 51 and the second supporting structure 52, thereby improve the packaging convenience of the packaging apparatus. When the subject 3 is packaged using the packaging apparatus, the first cross plate 534 and the second cross plate 535 mated crosswise may be placed into the protection space formed by the first supporting structure 51 and the second supporting structure 52 to provide protection for the subject 3.

It can be understood that the embodiments mentioned above are only some examples and not intended to limit the structure of protection plate 53 in the embodiments.

In some embodiments, the protection plate 53 can also be used alone without the need to cooperate with the first supporting structure 51 and the second supporting structure 52.

In some embodiments, the protection plate may be connected with the first supporting structure 51, and the protection plate may be folded to a certain position to protect the subject 3. In some embodiments, the protection plate may be used independently, and not connected with the first supporting structure 51 and/or the second supporting structure 52. The protection plate may be placed in a corresponding space to protect the product. Whether the protection plate is connected with the first supporting structure 51 and the second supporting structure 52 or not is not limited in the present disclosure. For example, the protection plate as described in Example 3 may be disposed independently from the first supporting structure 51 and the second supporting structure 52. The protection plate as described in Examples 1-2 may be connected with the first supporting structure 51 and/or the second supporting structure 52.

In order to protect the product in various ways, at least two of one or more folding plates (e.g., the first folding portion 131, the second folding portion 132, etc.), one or more protruding plates (e.g., the first protruding plate 111, the second protruding plate 121, etc.), one or more supporting plates (e.g., the first supporting plate 51, the second supporting plate 52, etc.) may be combined appropriately to form a new protection structure.

Having thus described the basic concepts, it may be rather apparent to those skilled in the art after reading this detailed disclosure that the foregoing detailed disclosure is intended to be presented by way of example only and is not limiting. Various alterations, improvements, and modifications may occur and are intended to those skilled in the art, though not expressly stated herein. These alterations, improvements, and modifications are intended to be suggested by this disclosure and are within the spirit and scope of the exemplary embodiments of this disclosure.

Moreover, certain terminology has been used to describe embodiments of the present disclosure. For example, the terms "one embodiment," "an embodiment," and/or "some embodiments" mean that a particular feature, structure, or characteristic described in connection with the embodiment is included in at least one embodiment of the present disclosure. Therefore, it is emphasized and should be appreciated that two or more references to "an embodiment" or "one embodiment" or "an alternative embodiment" in various portions of the present disclosure are not necessarily all referring to the same embodiment. Furthermore, the particular features, structures, or characteristics may be combined as suitable in one or more embodiments of the present disclosure.

Similarly, it should be appreciated that in the foregoing description of embodiments of the present disclosure, various features are sometimes grouped together in a single embodiment, figure, or description thereof to streamline the disclosure aiding in the understanding of one or more of the various inventive embodiments. This method of disclosure, however, is not to be interpreted as reflecting an intention that the claimed object matter requires more features than are expressly recited in each claim. Rather, inventive embodiments lie in less than all features of a single foregoing disclosed embodiment.

In some embodiments, the numbers expressing quantities, properties, and so forth, used to describe and claim certain embodiments of the application are to be understood as being modified in some instances by the term "about," "approximate," or "substantially." For example, "about," "approximate" or "substantially" may indicate ±20% variation of the value it describes, unless otherwise stated. Accordingly, in some embodiments, the numerical parameters set forth in the written description and attached claims are approximations that may vary depending upon the desired properties sought to be obtained by a particular embodiment. In some embodiments, the numerical parameters should be construed in light of the number of reported significant digits and by applying ordinary rounding techniques. Notwithstanding that the numerical ranges and parameters setting forth the broad scope of some embodiments of the application are approximations, the numerical values set forth in the specific examples are reported as precisely as practicable.

Each of the patents, patent applications, publications of patent applications, and other material, such as articles, books, specifications, publications, documents, things, and/or the like, referenced herein is hereby incorporated herein by this reference in its entirety for all purposes, excepting any prosecution file history associated with same, any of same that is inconsistent with or in conflict with the present document, or any of same that may have a limiting effect as to the broadest scope of the claims now or later associated with the present document. By way of example, should there be any inconsistency or conflict between the description, definition, and/or the use of a term associated with any of the incorporated material and that associated with the present document, the description, definition, and/or the use of the term in the present document shall prevail. In closing, it is to be understood that the embodiments of the application disclosed herein are illustrative of the principles of the embodiments of the application. Other modifications that may be employed may be within the scope of the application. Thus, by way of example, but not of limitation, alternative configurations of the embodiments of the application may be utilized in accordance with the teachings herein. Accordingly, embodiments of the present application are not limited to that precisely as shown and described.

What is claimed is:

1. A packaging apparatus, comprising:

a main body including a base plate, a first side plate, and a second side plate, the first side plate and the second side plate being distributed around the base plate; and an elastic sheet disposed above the base plate, the elastic sheet including a first fixing part and a second fixing part, the first fixing part and the second fixing part being connected with the first side plate and the second side plate, respectively, a space being configured between the base plate and the elastic sheet, wherein when the packaging apparatus is used to package a subject, the first side plate and the second side plate are folded away from a side of the base plate where the subject is located, and elastic pads or elastic supports, each of the elastic pads or the elastic supports being disposed between the base plate and the first side plate, or between the base plate and the second side plate, or on a lower side of the first side plate and the second side plate which is folded to the base plate.

2. The packaging apparatus of claim 1, wherein:

the elastic sheet is configured to position the subject on the base plate when the elastic sheet is stretched along the folding of the first side plate and the second side plate.

3. The packaging apparatus of claim 1, wherein the main body includes:

at least one folding plate disposed between the base plate and at least one of the first side plate or the second side plate; and each of the at least one folding plate being folded in half between the base plate and one of the first side plate and the second side plate when the first side plate and the second side plate are folded.

4. The packaging apparatus of claim 3, wherein:

a first folding line is disposed between each of the at least one folding plate and the base plate;

a second folding line is disposed between each of the at least one folding plate and one of the first side plate and the second side plate; and one or more cutting lines are disposed between each of the at least one folding plate and the base plate or each of the at least one folding plate and one of the first side plate and the second side plate, and each of the one or more cutting lines is connected with the first folding line and the second folding line.

5. The packaging apparatus of claim 4, wherein:

a third folding line is disposed between the first folding line and the second folding line, each of the at least one folding plate is divided into a first folding portion and a second folding portion along the third folding line, and the first folding portion and the second folding portion are folded in half along the third folding line between the base plate and the one of the first side plate and the second side plate when the first side plate and the second side plate are folded.

6. The packaging apparatus of claim 5, wherein:

a fourth folding line is disposed between the base plate and one of the first side plate and the second side plate corresponding to each of the at least one folding plate, and the third folding line is collinear with the fourth folding line.

7. The packaging apparatus of claim 3, wherein a shape of one of the at least one folding plate includes a triangle, a quadrilateral, or a hexagon.

8. The packaging apparatus of claim 3, wherein:

the at least one folding plate disposed between the first side plate and the base plate and the at least one folding plate disposed between the second side plate and the base plate are distributed symmetrically.

9. The packaging apparatus of claim 3, wherein:

a third folding line is disposed between the base plate and the at least one folding plate, or between the at least one folding plate and one of the first side plate or the second side plate, a cutting line is disposed between the at least one folding plate and one of the first side plate or the second side plate, or between the at least one folding plate and the base plate, and two ends of the cutting line are connected with two ends of the third folding line, respectively.

10. The packaging apparatus of claim 1, wherein the main body further includes:

a third side plate and a fourth side plate distributed around the base plate, and when the packaging apparatus is used to package the subject, the third side plate and the fourth side plate are folded toward the side of the base plate where the subject is located.

11. The packaging apparatus of claim 10, wherein the first side plate and the second side plate are two opposite side plates, and the third side plate and the fourth plate edge are two opposite side plates, the elastic sheet includes a first film and a second film, the first film including the first fixing part and the second fixing part, the second film including a third fixing part and a fourth fixing part, the third fixing part and the fourth fixing part being connected with the third side plate and the fourth side plate, respectively, and when the packaging apparatus is used to package the subject, the first film is stretched along the folding of the first side plate and the second side plate, and the second film is stretched along the folding of the third side plate and the fourth side plate.

12. The packaging apparatus of claim 11, wherein at least one of the first film and the second film includes two sub-films fixed at two relative top corners of the base plate, each of the two sub-films including the first fixing part and the second fixing part, the two sub-films corresponding to the first film are stretched along the folding of the first side plate and the second side plate to fix corresponding two relative corners of the subject, and the two sub-films corresponding to the second film are stretched along the folding of the third side plate and the fourth side plate to fix corresponding two relative corners of the subject.

13. The packaging apparatus of claim 1, wherein the elastic sheet includes two sub-films fixed at two relative top corners of the base plate, each of the two sub-films including the first fixing part and the second fixing part, and the two sub-films are stretched along the folding of the first side plate and the second side plate to fix two relative corners of the subject.

14. The packaging apparatus of claim 10, wherein the packaging apparatus further includes one or more corner plates disposed between each two adjacent side plates among the first side plate, the third side plate, the second side plate, and the fourth side plate.

15. The packaging apparatus of claim 1, wherein one or more tensile holes may be disposed on the elastic sheet.

16. The packaging apparatus of claim 1, wherein the elastic sheet includes one or more films.

* * * * *